US010027056B1

(12) United States Patent
Spangler

(10) Patent No.: US 10,027,056 B1
(45) Date of Patent: Jul. 17, 2018

(54) ELECTRICAL CONNECTOR

(71) Applicant: Google Inc., Mountain View, CA (US)

(72) Inventor: Randall R. Spangler, San Jose, CA (US)

(73) Assignee: GOOGLE LLC, Mountain View, CA (US)

( * ) Notice: Subject to any disclaimer, the term of this patent is extended or adjusted under 35 U.S.C. 154(b) by 0 days.

(21) Appl. No.: 15/445,085

(22) Filed: Feb. 28, 2017

Related U.S. Application Data

(63) Continuation of application No. 14/054,175, filed on Oct. 15, 2013.

(51) Int. Cl.
*H01R 13/62* (2006.01)
*H01R 24/28* (2011.01)
*H01R 103/00* (2006.01)

(52) U.S. Cl.
CPC ..... *H01R 13/6205* (2013.01); *H01R 24/28* (2013.01); *H01R 2103/00* (2013.01)

(58) Field of Classification Search
CPC .... H01R 2103/00; H01R 13/72; H01R 24/30; H01R 31/02; H01R 13/6392; H01R 31/06; H01R 2201/06; H01R 43/26; H01R 13/6205; H01R 24/28
See application file for complete search history.

(56) References Cited

U.S. PATENT DOCUMENTS 2,298,172 A 10/1942 Rose et al.
2,520,739 A 8/1950 Shaw et al.
2,708,714 A 5/1955 Stevens, Jr.
3,193,636 A 7/1965 Daniels
3,328,741 A 6/1967 Brown
3,665,509 A * 5/1972 Elkins ..... H01R 13/523 439/271
3,808,577 A 4/1974 Mathauser et al.
3,810,258 A * 5/1974 Mathauser ..... H01R 13/6205 439/246
3,995,209 A * 11/1976 Weston ..... H01F 38/14 323/355
4,077,690 A 3/1978 Koether
4,421,371 A * 12/1983 Clark ..... H01R 13/631 439/249

(Continued)

FOREIGN PATENT DOCUMENTS

EP 1670101 A1 6/2006
EP 1933259 A1 6/2008

(Continued)

OTHER PUBLICATIONS

Notice of Allowance for U.S. Appl. No. 14/054,175, dated Nov. 21, 2016, 10 pages.

(Continued)

*Primary Examiner* — Edwin A. Leon
*Assistant Examiner* — Oscar Jimenez
(74) *Attorney, Agent, or Firm* — Brake Hughes Bellermann LLP

(57) ABSTRACT

According to an example embodiment, an electrical connector may include a plug connected to a cord. The cord may be connected to a back of the plug. A width of the plug may narrow from the back of the plug to a front of the plug. The cord may be connected to the back of the plug. The cord may include at least one electrical wire.

18 Claims, 38 Drawing Sheets

(56) References Cited

U.S. PATENT DOCUMENTS 4,653,503 A 3/1987 Heath et al.
4,891,022 A * 1/1990 Chandler ..... H01R 13/6593 439/509
4,932,902 A * 6/1990 Crane, Jr. ..... H01R 13/26 439/627
4,978,306 A 12/1990 Robb
4,993,975 A 2/1991 Asick et al.
5,278,725 A 1/1994 Konno et al.
5,344,331 A * 9/1994 Hoffman ..... B60L 11/1818 439/138
5,460,545 A 10/1995 Carlson et al.
5,595,503 A 1/1997 Pittman et al.
5,751,544 A 5/1998 Song
5,771,540 A 6/1998 Carpenter et al.
5,917,307 A * 6/1999 Watanabe ..... H01F 38/14 320/108
5,941,729 A 8/1999 Sri-Jayantha
5,997,310 A 12/1999 Chiu et al.
6,290,079 B1 * 9/2001 Altherr ..... B61G 5/06 213/1.3
6,352,450 B1 * 3/2002 Bronk ..... H01R 25/006 439/111
6,431,887 B1 8/2002 Yeomans et al.
6,461,192 B1 10/2002 Kwoka
6,481,057 B2 11/2002 Lin
6,530,793 B2 3/2003 Eichhorn et al.
6,565,363 B2 * 5/2003 Downing ..... H01R 13/6205 439/38
6,986,674 B1 * 1/2006 Gorman ..... H01R 13/4538 174/66
7,055,215 B1 6/2006 Ligtenberg et al.
7,258,493 B2 8/2007 Milette
7,341,458 B1 3/2008 Koh et al.
7,645,143 B2 1/2010 Rohrbach et al.
7,748,986 B1 7/2010 Parnapy et al.
7,984,532 B2 7/2011 Huang
8,091,178 B2 1/2012 Degner et al.
8,758,025 B1 * 6/2014 Liljegren ..... H01R 13/6205 439/39
9,203,184 B1 12/2015 Hui
9,735,500 B2 * 8/2017 Magana ..... H01R 13/6205
2001/0031565 A1 * 10/2001 Sakiyama ..... H01T 1/06 439/38
2006/0024997 A1 2/2006 Teicher
2006/0065681 A1 3/2006 Yeh et al.
2007/0186382 A1 8/2007 Huang
2007/0275605 A1 * 11/2007 Hubbard ..... H01R 12/721 439/660
2010/0279517 A1 * 11/2010 Tsai ..... H01R 24/38 439/38
2011/0189863 A1 * 8/2011 Sare ..... H01R 13/6205 439/39
2011/0263144 A1 * 10/2011 Tiberghien ..... H01R 43/26 439/136
2011/0281444 A1 * 11/2011 Yasuoka ..... H01R 13/447 439/39
2012/0015561 A1 1/2012 Tsai
2012/0028498 A1 2/2012 Na et al.
2013/0115821 A1 5/2013 Golko et al.
2013/0303001 A1 * 11/2013 Greig ..... H01R 13/6205 439/39
2013/0323940 A1 * 12/2013 Coffey ..... G02B 6/36 439/38
2014/0113461 A1 * 4/2014 Kim ..... H01R 13/6205 439/39
2014/0162468 A1 * 6/2014 Kim ..... H01R 13/6205 439/39
2014/0193997 A1 * 7/2014 Lam ..... H01R 13/631 439/474
2014/0213112 A1 * 7/2014 Bandis ..... H01R 13/447 439/626
2015/0093918 A1 * 4/2015 Underwood ..... H01R 13/6205 439/39
2015/0121673 A1 * 5/2015 Richards ..... H01R 13/631 29/407.1
2015/0244105 A1 * 8/2015 Peng ..... H01R 13/6205 439/39
2015/0293311 A1 * 10/2015 Coffey ..... G02B 6/36 385/139
2017/0040734 A1 * 2/2017 Ramones ..... H01R 43/26

FOREIGN PATENT DOCUMENTS

KR 20140050891 A * 4/2014 ..... H01R 13/6205
WO 2011150403 A1 12/2011

OTHER PUBLICATIONS

Response to Final Office Action for U.S. Appl. No. 14/054,175, filed on Aug. 11, 2016, 16 pages.
Response to Final Office Action for U.S. Appl. No. 14/054,175, filed on Sep. 23, 2016, 14 pages.
"Bare PCB Test Probes", Datasheet, Feb. 16, 2012, 1 page.
"Apple is Granted 6 MacBook Pro Design Patents in Hong Kong", Patently Apple, retrieved on Apr. 16, 2013 from www.patentlyapple.com/patently-apple/2013/04/apple-is-granted-6-macbook-pro-design-patents-in-hong-kong.htm, 9 pages.
"Apple Mag-Safe Adapter", "Apple Mag-Safe Adapter", Apr. 12, 2013, 1 page., Apr. 12, 2013, 1 page.
"DisplayPort", "DisplayPort", from Wikipedia, the free encyclopedia, Sep. 4, 2013, 13 pages.
"HDMI", from Wikipedia, the free encyclopedia, Sep. 4, 2013, 30 pages.
"MacBook Pro (Retina, 15-inch, Early 2013)—Technical Specifications", Mar. 19, 2013, 4 pages.
Advisory Action for U.S. Appl. No. 14/054,175, dated Sep. 20, 2016, 3 pages.
Advisory Action for U.S. Appl. No. 14/054,175, dated Sep. 24, 2015, 4 pages.
Final Office Action for U.S. Appl. No. 14/054,175, dated Jun. 23, 2016, 13 pages.
Final Office Action for U.S. Appl. No. 14/054,175, dated Jun. 18, 2015, 20 pages.
Non Final Office Action for U.S. Appl. No. 14/054,175, dated Dec. 31, 2014, 25 pages.
Non-Final Office Action for U.S. Appl. No. 14/054,175, dated Jan. 8, 2016, 19 pages.
Response to Final Office Action for U.S. Appl. No. 14/054,175, filed on Sep. 2, 2015, 11 pages.
Response to Non Final Office Action for U.S. Appl. No. 14/054,175, filed on Apr. 1, 2016, 11 pages.
Response to Non-Final Office Action for U.S. Appl. No. 14/054,175, filed on Mar. 25, 2015, 13 pages.
International Search Report and Written Opinion for PCT Application No. PCT/US14/10050, dated Mar. 28, 2014, 15 Pages.
Schock, "How to Fix a Wobbly Macbook Pro Screen", retrieved from schock.net/articles/2012/02/20/how-to-fix-a-wobbly-macbook-pro-screen/, Feb. 20, 2012, 4 pages.

* cited by examiner

ELECTRICAL CONNECTOR

CROSS-REFERENCE TO RELATED APPLICATION

This application is a Continuation of, and claims priority to, U.S. patent application Ser. No. 14/054,175, filed on Oct. 15, 2013, entitled "ELECTRICAL CONNECTOR WITH RECESSED CONTACT AND SOCKET FOR RECEIVING ELECTRICAL CONNECTOR", the disclosure of which is incorporated by reference herein in its entirety.

TECHNICAL FIELD

This description relates to electrical connectors to provide power and/or signals to electrical devices, and the sockets of the electrical devices that receive the electrical connectors.

BACKGROUND

Electrical connectors serve as a conduit to provide power and/or data to an electrical device from an external source. Electrical connectors may provide power and/or data to, for example, a portable computing device such as a laptop or notebook computer. If the electrical connector is pulled on in a direction lateral to the direction of insertion into the electrical device, adverse events may occur. For example, the electrical device may be pulled off of a table onto a floor, the electrical connector may be damaged, or the socket may be damaged.

SUMMARY

According to one general aspect, an electrical connector may include a plug connected to a cord. The cord may be connected to a back of the plug. A width of the plug may narrow from the back of the plug to a front of the plug. The cord may be connected to the back of the plug. The cord may include at least one electrical wire.

According to one general aspect, an electrical socket may include at least one wall defining a cavity and an electrical connector extending into the cavity. The cavity may have a width along an opening of the cavity that is at least as great as a depth of the cavity, the depth of the cavity being from the opening of the cavity to a back of the cavity. A width of the cavity may decrease from the opening of the cavity to a back of the cavity.

According to another general aspect, an electrical connector may include a circular plug connected to a cord and the cord. The circular plug may have a height from a top of the circular plug to a bottom of the circular plug, a radius of the circular plug being at least twice the height of the plug.

The details of one or more implementations are set forth in the accompanying drawings and the description below. Other features will be apparent from the description and drawings, and from the claims.

DETAILED DESCRIPTION

Figure 1A:
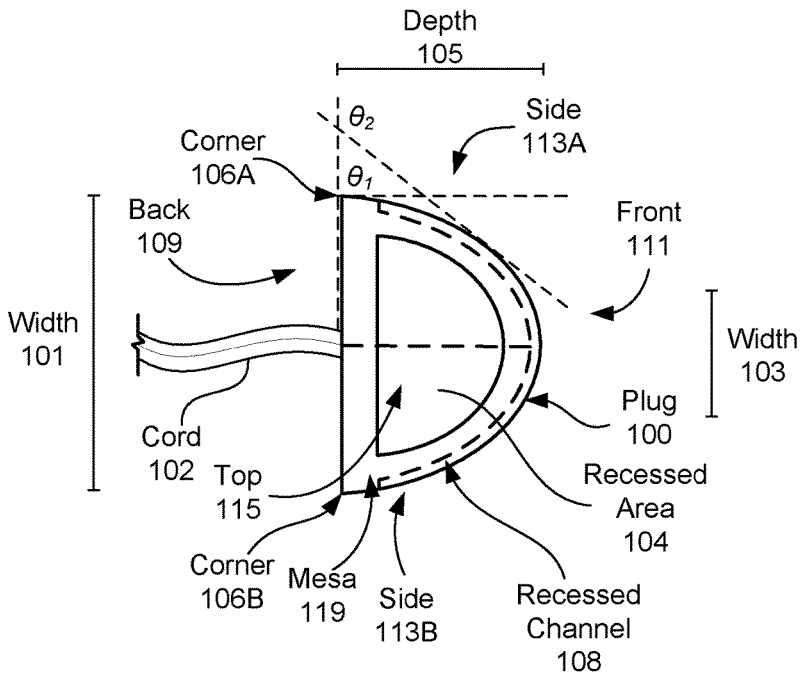
FIG. 1A is a diagram of a rounded plug according to an example embodiment.

FIG. 1A is a diagram of a rounded plug 100 according to an example embodiment. In the embodiments described herein, an electrical connector may include a plug and a cord, as shown in any of the figures. The plug 100 may be rounded or semi-circular. The plug 100 may be used to provide power to a computing device. The plug 100 may be coupled to an electrical cord 102. The electrical cord 102 may have one or more electrical wires that provide power and/or signals to the computer via the plug 100. The electrical cord 102 may connect to a power outlet or another computing device at an end of the electrical cord 102 that is opposite from the end of the electrical cord that enters the plug 100. The electrical cord 102 may enter the plug 100 through a back 109 of the plug 100.

The plug 100 may be rounded, and may or may not have sides beginning perpendicular to the back 109. The back 109 of the plug 100 may be flat, with sides 113A, 113B and a front 111 of the plug 100 being rounded. In the example shown in FIG. 1A, a back portion of each side 113A, 113B is perpendicular, or nearly perpendicular, to the back 109 of the plug 100. An angle $\Theta_1$ formed by an intersection of a plane parallel to the back portion of the sides 113A, 113B with a plane parallel to the back 109 of the plug 100 may have an angle of ninety degrees in the example in which the plug 100 has sides that begin perpendicular to the back 109. In this example, the plug 100 may form a half-circle. In the example of the half-circle plug 100, the side 113A may be perpendicular or nearly perpendicular to the back 109 of the plug 100 at a back corner 106A of the plug 100, and the side 113B may be perpendicular or nearly perpendicular to the back 109 of the plug 100 at a back corner 106B of the plug 100. However, in other examples, the plug 100 may form a semi-circle that forms an arc of less than a half-circle, and the angle $\Theta_1$ may be greater than ninety degrees.

The rounded shape of the plug 100 may cause an angle $\Theta_2$, which may be formed by an intersection of the plane parallel to (e.g., aligned parallel to) the back of the plug 100 with a plane tangent to a middle portion of the side 113A of the plug 100, to be greater than the angle $\Theta_1$. The increasing angle $\Theta_2$ results from the curved and/or rounded shape of the plug 100. The angle $\Theta_2$ may increase from portions of the side 113A, 113B that are closer to the back 109 to portions of the side 113A, 113B that are closer to the front 111; portions of the side 113A, 113B that are closer to the front 111 of the plug 100 may have greater angles $\Theta_2$ than portions of the side 113A, 113B that are closer to the back 109 of the plug 100. At the front 111 of the plug 100, the angle $\Theta_2$ may approach 180 degrees.

A width 101 of the plug 100, measured as a distance between the sides 113A, 113B along the back 109 of the plug 100 and/or between the corners 106A, 106B of the plug 100, may be at least as great, or even greater, such as twice as great, as a depth 105 of the plug 100. The depth 105 of the plug 100 may be measured from the back 109 of the plug 100 to the front 111 of the plug 100. A width 103 of the plug 100 may decrease as a function of distance from the back 109 of the plug 100; the width 103 of the front 111 of the plug 100 may, for example, be less than one-half, less than one-third, or less than one-fourth of the width 101 of the back 109 of the plug 100, according to example embodiments.

The plug 100 may include a recessed area 104. The recessed area 104 may be defined by a mesa 119. The mesa 119 may extend along a perimeter of the top 115 of the plug 100. The mesa 119 may have a equal width along the perimeter of the top 115 of the plug 100, resulting in the recessed area 104 having a similar, reduced shape to the plug 100, or the width of the mesa 119 may differ along the perimeter of the top 115 of the plug 100.

The recessed area 104 may include a recessed connector plate, which can receive a latch or spring from a socket of the computing device into which the plug 100 is inserted. The recessed area 104 may secure the plug 100 into the socket of the computing device. The recessed area 104 and mesa 119 may, together, form a retention feature to secure the plug 100 into the socket, allowing the plug 100 to rotate and/or slide within limits created by the mesa 119. The recessed area 104 may be on or included in a top 115 (or top portion) of the plug 100. The recessed area 104 may have a width that decreases as a function of distance from the back 109 of the plug 100, allowing the plug 100 to rotate within a socket. The recessed area 104 may, for example, have a rounded front portion that is closer to the front 111 of the plug 100 than to the back 109 of the plug 100. The recessed area 104 may, for example, be semi-circular.

The plug 100 may also include a recessed channel 108. The recessed channel 108 may extend around the front 111 and portions of the sides 113A, 113B of the plug 100. The recessed channel 108 may protect a power connector 110 (shown in FIGS. 1B and 1C).

Figure 1B:
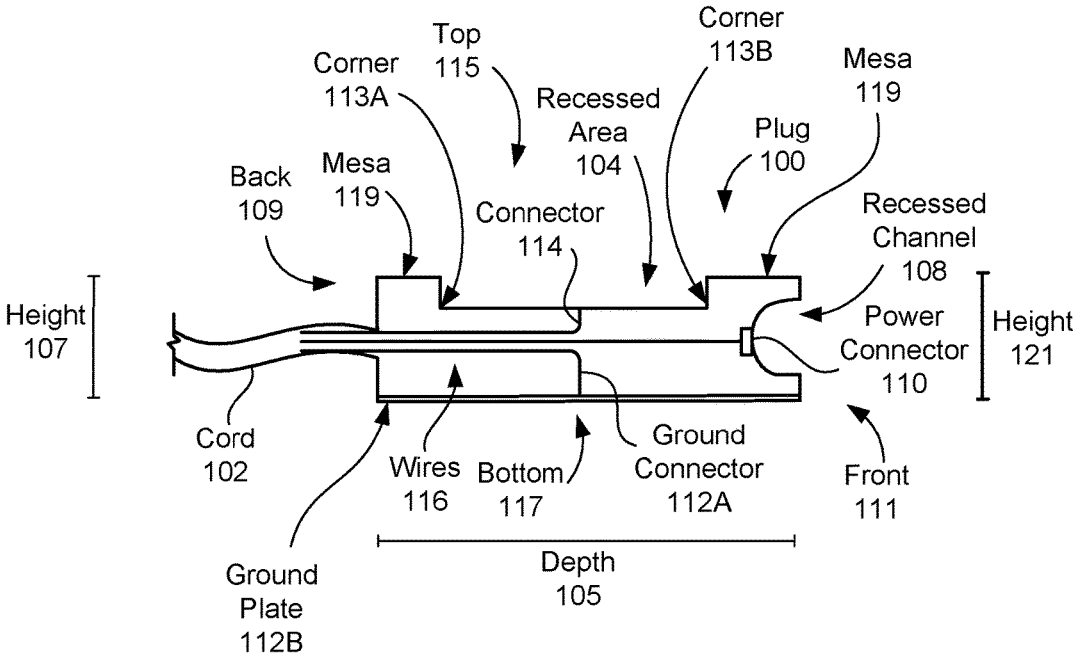
FIG. 1B is a side, cross-sectional view of the rounded plug shown in FIG. 1A according to an example embodiment.

FIG. 1B is a side, cross-sectional view of the rounded plug 100 shown in FIG. 1A according to an example embodiment. The cross-section of the plug 100 may be along the horizontal dashed line through the middle of the plug 100 shown in FIG. 1A. As shown in FIG. 1B, the retention feature may include the recessed area 104 which receives a latch or spring-loaded connector from a socket into which the plug 100 is inserted. The recessed area 104 may be surrounded and/or defined by the mesa 119. The mesa 119 may have a substantially equal height along all portions surrounding the recessed area 104, or may have different heights at different portions. The mesa 119 may form sharp, ninety-degree corners 113A, 113B extending up from the recessed area 104, or may have rounded corners extending from the recessed area 104, according to example embodiments.

The plug 100 may include an electrical connector 114 extending into, or flush or even with, the recessed area 104. The electrical connector 114 may be coupled to one or more wires in the cord 102 via one or more wires 116 in the plug 100. The electrical connector 114 may carry power and/or signals from a device, such as a power source or other computing device, to the computing device into which the plug 100 is inserted. The connector 114 may couple to an electrical connector in a socket that engages the retention feature (which may include the recessed area 104 and mesa 119). The location of the electrical connector 114 in the recessed area 104 may allow an electrical connector of the socket to serve as both an electrical connector and a retention feature. In an example embodiment, the electrical connector 114 may extend along most or all of the bottom of the recessed area 104. The extension of the electrical connector 114 along most or all of the bottom of the recessed area 104 may allow the electrical connector of the socket to maintain electrical coupling with the electrical connector 114 while the plug 100 rotates within the socket within the limits allowed by the mesa 119.

Figure 1C:
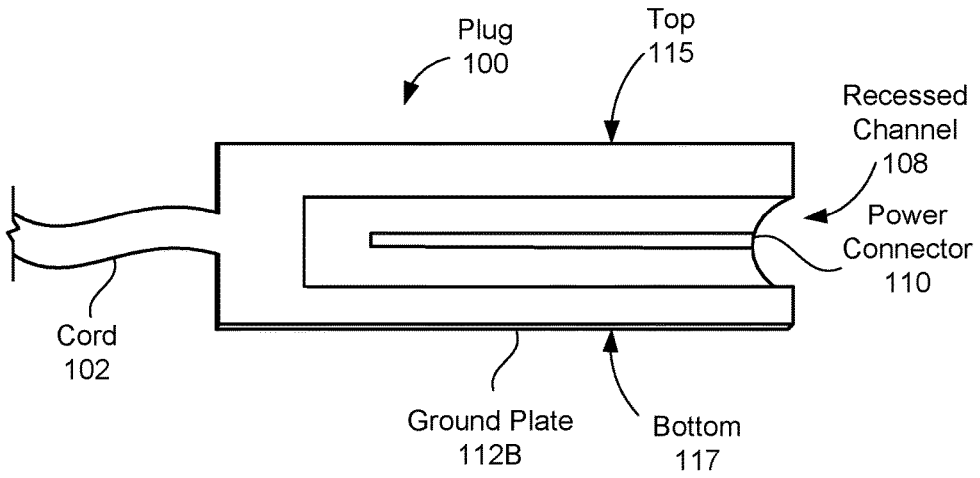
FIG. 1C is another side view of the plug shown in FIGS. 1A and 1B according to an example embodiment.

The front 111 of the plug 100 may include a recessed channel 108. The recessed channel 108 may be at the front 111 of the plug 100, and may extend along the sides of the plug 100, as also shown in FIGS. 1A and 1C. A power connector 110 may be at or near a bottom of the recessed channel 108. The power connector 110 may be an electrical connector coupled to at least one wire in the cord 102 via one or more wires 116 in the plug 100. The power connector 110 may provide power to a computing device into which the plug 100 is inserted, and/or may provide data signals to the computing device into which the plug 100 is inserted. The recessed channel 108 may protect the power connector 110 from accidentally contacting and/or coupling with conductive devices or components and causing short circuits.

The plug 100 may also include an electrical connector, such as a ground connector 112A, coupled to a ground plate 112B, on the bottom 117 of the plug 100. The ground plate 112B may be on a non-recessed area on the bottom 117 of the plug 100, and need not be protected by a recessed area 104 or retention feature or recessed channel 108, as with the connectors 114, 110. The bottom 117 of the plug 100 may be flat or concave. A concave bottom 117 may secure the plug 100 within a socket. The ground plate 112B may run along all or a portion of the bottom 117 of the plug 100. The ground plate 112B need not be protected by a recessed area because ground is safe to contact other components. The ground plate 112B may be coupled to the ground connector 112A and one or more electrical wires 116 in the plug 100 which are connected to one or more electrical wires in the cord 102. While the terms, "top" and "bottom" are used herein, these are relative terms, and features or components described as being on a top of a device may be located on a bottom of a device, and features or components described as being on the bottom of the device may be located on the top of the device.

The plug 100 may also include the wires 116. The wires 116 may couple to the connector 114, the power connector 110, and the ground connector 112A. The wires 116 may also extend through the cord 102 to a power source and/or data source.

The plug 100 may have a height 107 measured from the top 115 of the mesa 119 of the plug 100 to the bottom 117 of the plug 100. The height 107 may be measured in a direction perpendicular to the direction in which the width 101 and/or depth 105 was measured. The width 101 and/or depth 105 of the plug 100 may be greater than the height 107 of the plug 100, such as at least twice, at least three times, at least four times, or at least five times the height 107 of the plug 100.

FIG. 1C is a side view of the plug 100 shown in FIGS. 1A and 1B according to an example embodiment. As shown in FIG. 1C, the power connector 110 may be located in the recessed channel 108 of the plug 100. The ground connector plate 112B may extend along the bottom 117 of the plug 100. In the example shown in FIGS. 1B and 1C, the ground plate 112 extends only the bottom 117 of the plug 100. However, in other example embodiments, the ground plate 112A may extend on both the bottom 117 of the plug 100 and along the top 115 of the plug 100, such as along a top of the mesa 119 (not labeled in FIG. 1C). In this example, the plug 100 includes the power connector 110 and ground plate 112B (which is coupled to the power connector 112A shown in FIG. 1B), but not the connector 114 shown in the example of FIG. 1B.

As shown in FIG. 1C, the recessed channel 108 and power connector 110 may extend along front and side portions of the plug 100. The extension of the recessed channel 108 and power connector 110 along the front and side portions of the plug 100 may allow the power connector 110 to maintain electrical coupling with a connector of the socket while the plug 100 rotates within the socket within the limits allowed by the mesa 119 (labeled in FIGS. 1A and 1B).

Figure 2A:
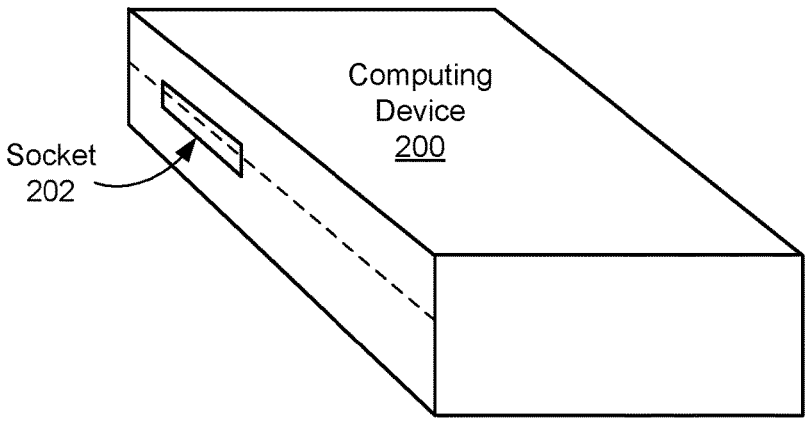
FIG. 2A shows a computing device with a socket configured to receive the plug shown in FIGS. 1A, 1B, and 1C according to an example embodiment.

FIG. 2A shows a computing device 200 with a socket 202 configured to receive the plug 100 shown in FIGS. 1A, 1B, and 1C according to an example embodiment. The computing device 200 may receive power and/or data from the plug 100 and the cord 102 via the socket 202. The socket 202 may be on a side, back, or front of the computing device 200.

Figure 2B:
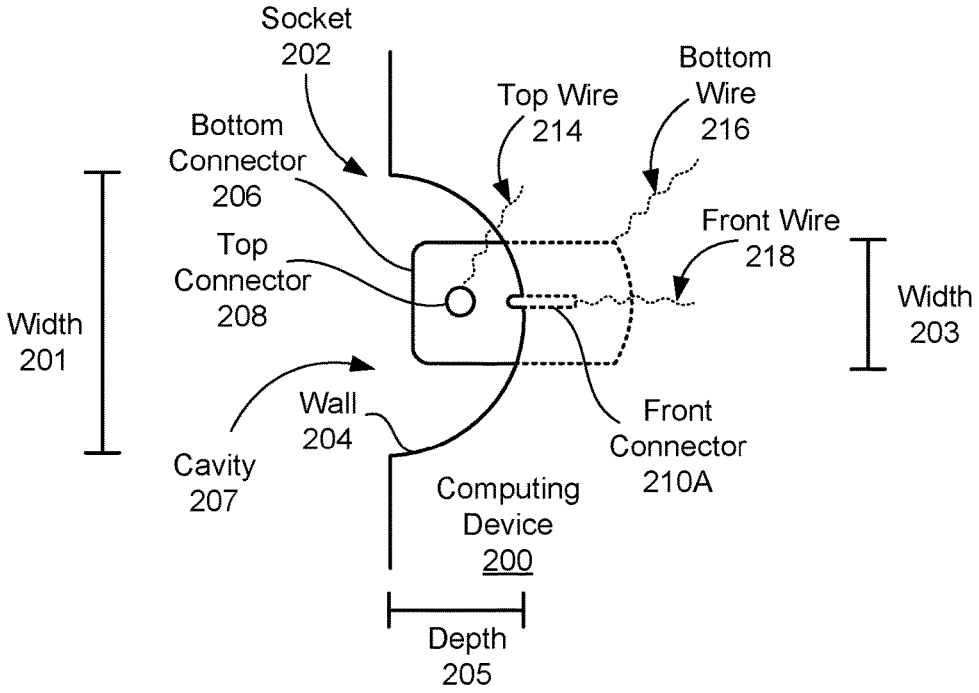
FIG. 2B is a cut-away view of the computing device including the socket shown in FIG. 2A according to an example embodiment.

FIG. 2B is a cut-away view of the computing device 200 including the socket 202 shown in FIG. 2A according to an example embodiment. The cut-away is along the dashed lines shown in FIGS. 2A and 2D. The socket 202 may be semi-circular and/or rounded. In this example, a wall 204 may be recessed in the shape of the plug 100 so that the socket 202 can receive the plug 100. A bottom connector 206 may extend into a bottom area of the socket 202 and couple with the ground connector 112. The bottom connector 206 may include a wire or curved metal that engages the ground connector 112 of the plug 100, securing the plug 100 within the socket 200. A portion of the bottom connector 206 may extend into the socket 202, and another portion(s) may be below a bottom wall of the socket 202, as shown by the dashed lines of the bottom connector 206 and also shown in FIG. 2D.

A top connector 208 may extend from a top of the socket 202 and couple to the connector 114 and engage the retention feature, securing the plug 100 within the socket 202. The top connector 208 may be coupled to wires or other transmission media within the computing device 200 as discussed below, or may be merely a retaining device that secures the plug 100 within the socket 202. A front connector 210A may engage the power connector 110 of the plug 100, receiving power from the plug 100. In this example, the front connector 210A may include a pin or rod that engages the power connector 110 of the plug 110.

The computing device 200 may have wires which receive power and/or signals from the connectors 110, 112, 114 of the plug 100. The computing device 200 may include the front wire 218 that couples to the power connector 110 of the plug 100 via the front connector 210A, a top wire 214 that couples to the connector 114 of the plug 100 via the top connector 208, and a bottom wire 216 that couples to the ground connector 112 of the plug 100 via the bottom connector 206. In an example in which the plug 100 does not include the connector 114, the socket 202 and computing device 200 may not include the front connector 210A and the front wire 218.

The wall 204 may define a cavity 207 which receives the plug 100. The cavity 207 may have a shape corresponding to the shape of the front 111 and sides 113A, 113B of the plug 100. The cavity 207 may have a width 201 along an opening of the cavity 207 that is at least as great as a depth 205 of the cavity 207. The depth 205 of the cavity 207 may be measured from the opening of the cavity 207 to the back of the cavity 207. The cavity 207 may also have a width 203 at inner portions of the cavity 207, corresponding to the width 103 at the sides 113A, 113B and front 111 of the plug 100, that is less than the width 201 at the opening of the cavity 207. The width 203 may decrease at deeper portions of the cavity 207 that are farther from the opening of the cavity 207.

Figure 2C:
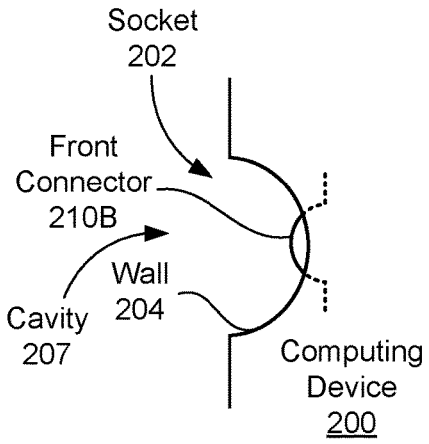
FIG. 2C is another cut-away view of the computing device including the socket shown in FIGS. 2A and 2B according to an example embodiment.

FIG. 2C is another cut-away view of the computing device 200 including the socket 202 shown in FIGS. 2A and 2B according to an example embodiment. The wall 204 may define a rounded recess or cavity 207 to receive the plug 100. The socket 202 may include a front connector 210B which may couple to the power connector 110 of the plug 100. The socket 202 may include a front connector 210A in pin or rod form as shown in FIG. 2B, or the socket 202 may include a front connector 210B which includes a curved wire, at least a portion of which runs generally parallel to the opening of the socket 202. The front connector 210B, in the form of a wire, may make broad contact with the power connector 110. The wire of the front connector 210B may act as a spring to improve contact with the power connector 110.

Figure 2D:
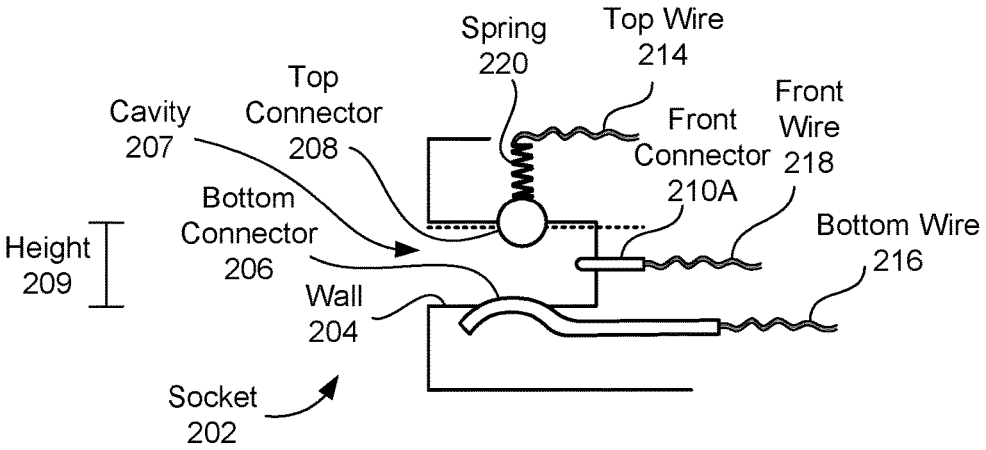
FIG. 2D is a side cut-away view of the computing device including the socket shown in FIGS. 2A, 2B, and 2C according to an example embodiment.

FIG. 2D is a side cut-away view of the computing device 200 including the socket 202 shown in FIGS. 2A, 2B, and 2C according to an example embodiment. The horizontal dashed line shows the location of the cut-away in FIG. 2B. The wall 204 may define the recessed region or cavity 207, which may be rectangular from this perspective, and which receives the plug 100. The bottom connector 206 may be flat, or may be convex or curved, or may include one or more spring-loaded pins or pads to improve contact with the ground connector 112 of the plug 100 (as shown in FIG. 20F). In the example shown in FIG. 2D, the bottom connector 206 may include a biased member, such as a curved piece of metal, which engages the bottom 117 of the plug 100, securing the plug 100 within the socket 202.

The front connector 210A, in pin or rod form, may include one or more spring-loaded pins or pads. The spring-loaded pins or pads may bias the front connector 210A into the cavity 207, so that the plug 100, when inserted into the socket 202, pushes the front connector 210A back into the computing device 200, and the spring-loaded pins or pads push the front connector 210A back against the power connector 110, maintaining the coupling between the front connector 210A and the power connector 110. The top connector 208 may include a ball coupled to the top wire 214 via a spring 220. The spring 220 may press downward on the top connector 208, which in turn will press downward into the recessed area 104, securing the plug 100 within the socket 202 and maintaining electrical coupling between the top connector 208 and the connector 114 of the plug 100.

The socket 202 may include a height 209 measured from a top of the opening of the recessed region or cavity 207 to a bottom of the opening of the recessed region or cavity 207. The height 209 may be measured in a direction perpendicular to the width 201 (shown in FIG. 2B). The height 209 of the socket 202 may be less than the width 201 of the socket 202. The width 201 may, for example, be at least twice, at least three times, at least four times, or at least five times the height 201 of the socket 202.

Figure 3A:
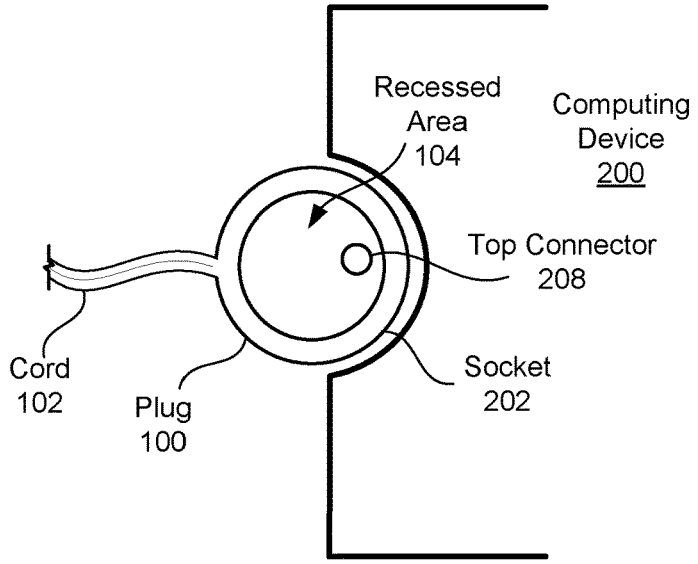
FIG. 3A is a diagram with a top cut-away view showing the plug within the socket of the computing device according to an example embodiment.

FIG. 3A is a diagram with a top cut-away view showing the plug 100 within the socket 202 of the computing device 200 shown in FIGS. 2A through 2D according to an example embodiment. While this example shows a circular plug 100 described in greater detail below with respect to FIGS. 4A, 4B, 4C, 5, 6A, 6B, 7A, and 7B, the features of a plug with a rounded front portion being inserted into and pulled out of the socket 202 may also apply to the plug 100 described above. Because the plug 100 and socket 202 may have similar features to those described above with respect to FIGS. 1A, 1B, 1C, 2A, 2B, 2C, and 2D, the same reference numbers will be used.

In this example, the top connector 208 of the socket 202 may engage the retention feature of the plug 100, securing the plug 100 within the socket 202 of the computing device 200. In this example, the cord 102 extends from the plug 100 in a direction generally perpendicular to a side or back of the computing device 200. The circular or semi-circular shape of the plug 100 allows the plug 100 to rotate freely within the socket 202.

Figure 3B:
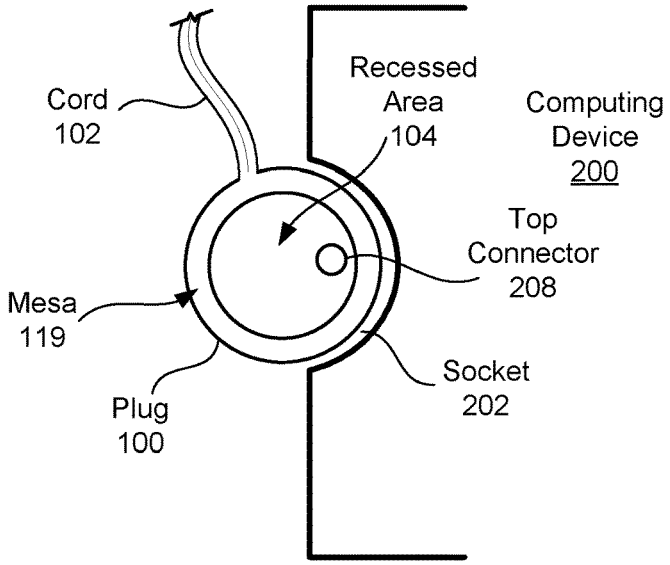
FIG. 3B is another diagram showing the plug within the socket of the computing device according to an example embodiment.

FIG. 3B is another diagram showing the plug 100 within the socket 202 of the computing device 200 according to an example embodiment. The plug 100 has rotated within the socket 202 from the orientation shown in FIG. 3A to the orientation shown in FIG. 3B. The rounded shape of at least a portion of the plug 100, and larger area of the recessed area 104 of the plug 100 than the top connector 208 of the socket 202, allows the plug 100 to rotate within the socket 202. The recessed area 104 may, for example, be similar to the recessed area defined by the mesa 119 that allow rotation of the plug 100 within the socket 202 in a similar manner to the recessed area 104 and mesa 119 described above with respect to FIGS. 1A and 1B. The rounded recessed area 104 allows the plug 100 to rotate within the socket 202, while the top connector 208 continues to engage the recessed area 104 and secure the plug 100 within the socket 202.

Figure 3C:
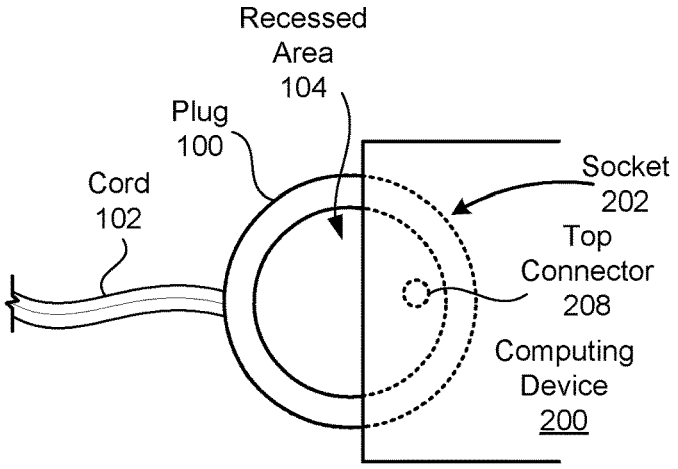
FIG. 3C is a diagram showing the plug within the socket of the computing device according to an example embodiment.

FIG. 3C is another diagram showing the plug 100 within the socket 202 of the computing device 200 according to an example embodiment. The plug 100 may remain in the socket 202 and rotate within the socket 202. Again, the rounded shape of the plug 100 and recessed area 104 allow the plug 100 to rotate within the socket 202, while the top connector 208 still secures the plug 100 within the socket 202.

Figure 3D:
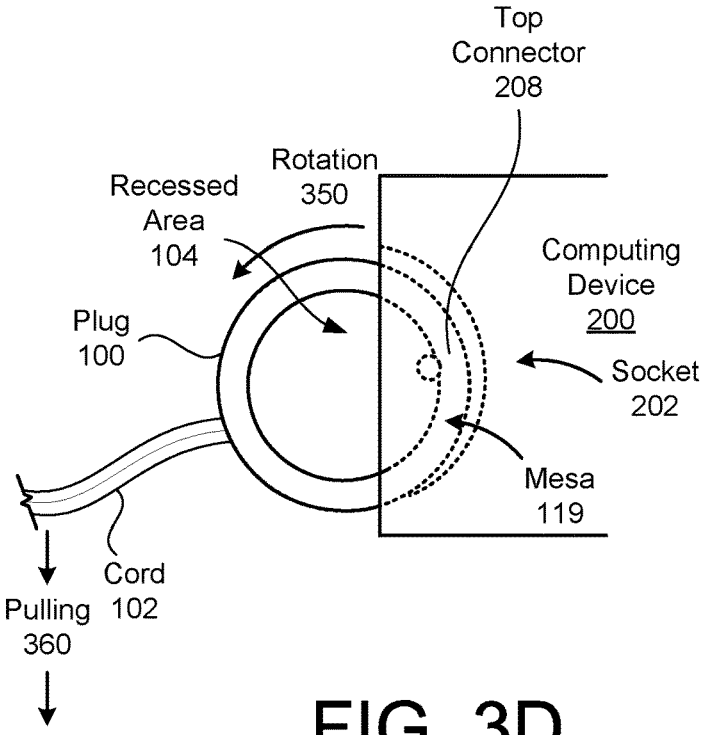
FIG. 3D is a diagram showing the plug rotate out of the socket according to an example embodiment.

FIG. 3D is a diagram showing the plug 100 rotate out of the socket 202 according to an example embodiment. In this example, the plug 100 has been pulled sideways in pulling direction 360 away from the socket 202, causing the plug 100 to rotate in the direction of rotation 350. The plug 100 will be pulled away in the direction of rotation 350 and a mesa 119 which surrounds the recessed area 104 will be in contact with the top connector 208. The top connector 208 of the socket 202 will be forced upward in a direction normal to the direction of rotation 350 (the upward direction is facing the reader from FIG. 3D), releasing the plug 100 from the socket 202.

Figure 3E:
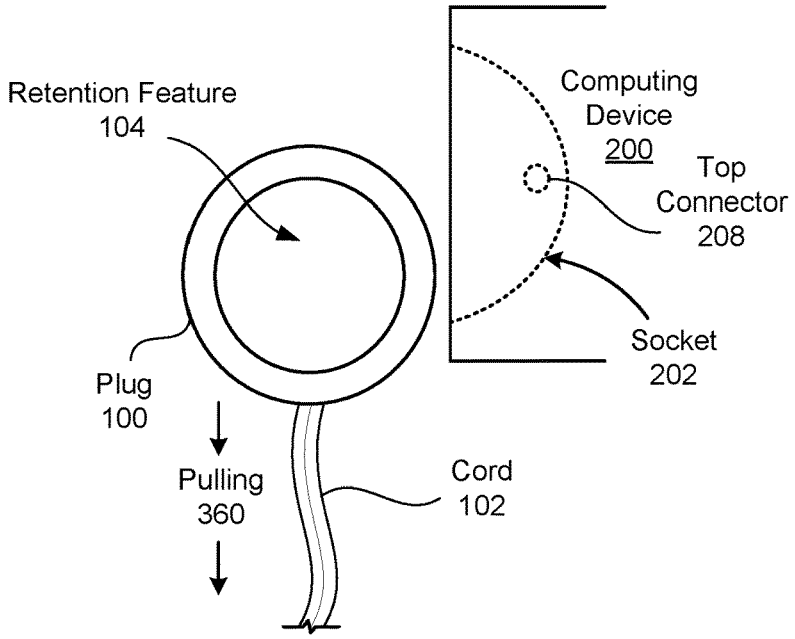
FIG. 3E is a diagram showing the plug after it has come out of the socket according to an example embodiment.

FIG. 3E is a diagram showing the plug 100 after it has come out of the socket 202 according to an example embodiment. In this example, the plug 100 has been rotated away from the socket 202 in the direction of rotation 350 (labeled in FIG. 3D) and pulled away from the computing device 200 in the pulling direction 360, with the top connector 208 no longer engaging the recessed area 104 of the plug 100.

Figure 3F:
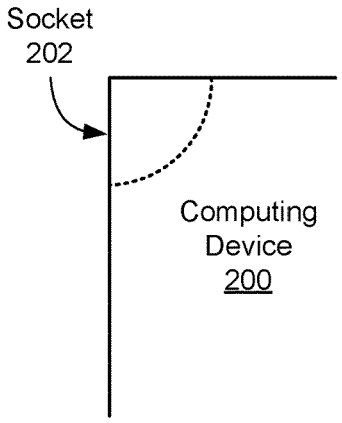
FIG. 3F is a diagram showing an example in which the socket is in a corner of the computing device according to an example embodiment.

FIG. 3F is a diagram showing an example in which the socket 202 is in a corner of the computing device 200 according to an example embodiment. In this example, the socket 202 is located in a corner of the computing device 200 and forms a semi-circle with about a ninety-degree arc.

Figure 3G:
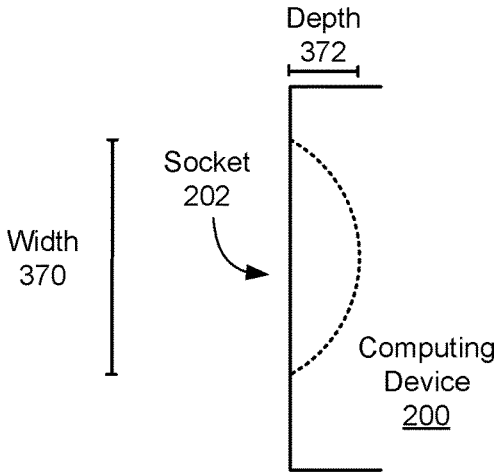
FIG. 3G shows an example in which the socket forms a crescent within the computing device according to an example embodiment.

FIG. 3G shows an example in which the socket 202 forms a crescent within the computing device 200 according to an example embodiment. In this example, the socket 202 forms a crescent or semi-circle with an arc that is less than half of a circle. The socket 202 may, for example, have a width 370 that is greater than twice a depth 372 of the socket 202. The socket 202 may, for example, have a width 370 that is at least three times, at least four times, or at least five times the depth 372 of the socket 202.

Figure 3H:
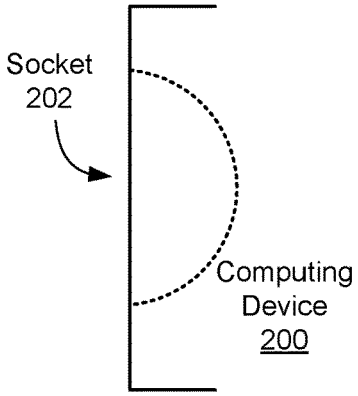
FIG. 3H is a diagram in which the socket is located in a side of the computing device and forms a half-circle according to an example embodiment.

FIG. 3H is a diagram in which the socket 202 is located in a side of the computing device 200 and forms a semi-circle and/or half-circle according to an example embodiment. In this example, the socket 202 is a half-circle with the full one-hundred and eighty degree arc.

Figure 3I:
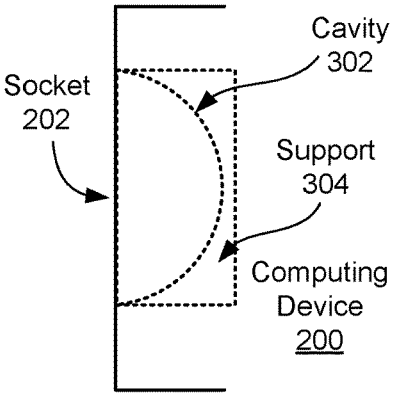
FIG. 3I is a diagram in which the socket is in a side of the computing device according to an example embodiment.

FIG. 3I is a diagram in which the socket 202 is in a side of the computing device 200 according to an example embodiment. In this example, the socket 202 defines a cavity 302 which may be a half-circle or less than a half-circle, but has a support 304 surrounding the cavity 302 which is rectangular. The support 304 may be part of the socket 202 and provide structural protection for the socket 202 and cavity 302. The support 304 may be secured to the computing device 200 by fasteners, such as bolts and nuts, screws, or by an adhesive.

Figure 4A:
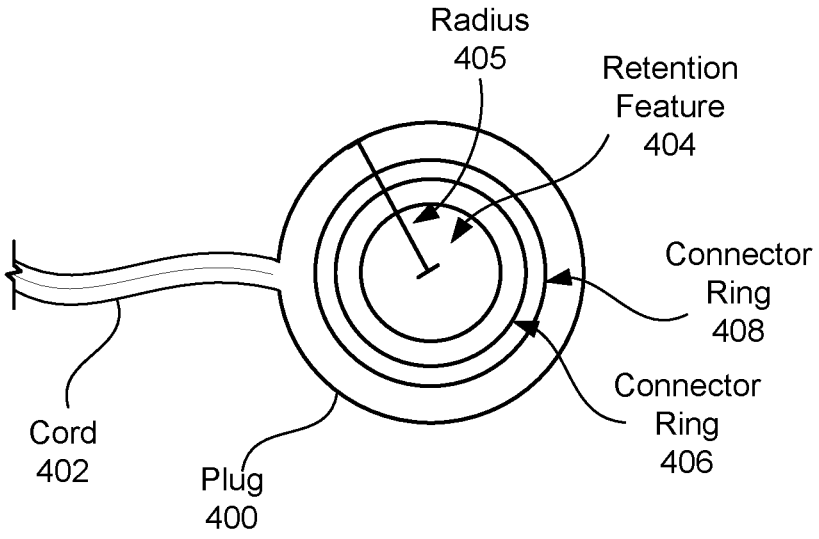
FIG. 4A is a diagram showing a circular plug according to an example embodiment.

FIG. 4A is a diagram showing a circular plug 400 according to an example embodiment. The circular plug 400 may have a radius 405 measured from a center of the plug 400 to an outer edge of the plug 400. The radius 405 of the circular plug 400 may be greater than a height of the circular plug 400. The radius 405 may, for example, be at least twice, at least three times, at least four times, or at least five times the height of the circular plug 400.

In the example shown in FIG. 4A, the plug 400 includes two connector rings 406, 408 and a retention feature 404 according to an example embodiment. The retention feature 404 may include a recessed area and mesa similar to the example plug described above with respect to FIGS. 1A, 1B, and 4C, and may receive a biased member from the socket to secure the plug 400 within the socket.

The plug 400 may include two circular connector rings 406, 408 which may include circular, conductive materials which transmit power and/or data. Either or both of the connector rings 406, 408 may surround the recessed retention feature 404, or be inside the recessed area of the retention feature 404. The connector rings 406, 408 may couple to connectors of a socket, and may transmit power and/or signals to the socket.

The plug 400 may be coupled or connected to a cord 402 with wires included in the cord 402. The wires included in the cord 402 may be coupled to the connector rings 406, 408.

Figure 4B:
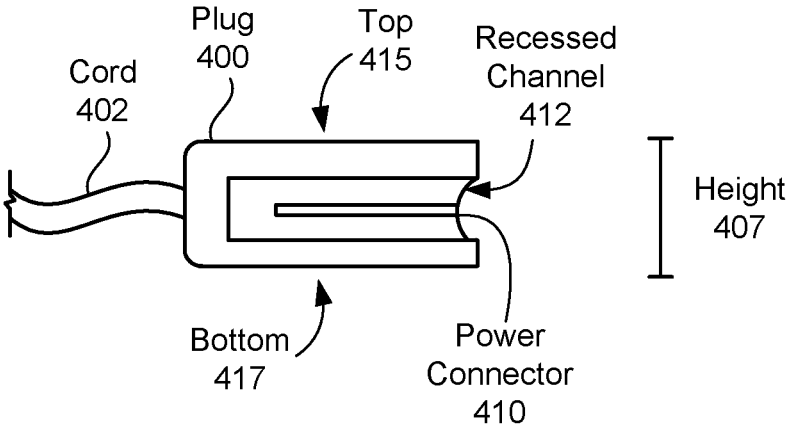
FIG. 4B is a side view of the plug shown in FIG. 4A according to an example embodiment.

FIG. 4B is a side view of the plug 400 shown in FIG. 4A according to an example embodiment. In this example, the plug 400 includes a recessed channel 412 protecting a power connector 410. The power connector 410 may be coupled to a wire in the cord 402. The power connector 410 may couple to a power connector from the socket and provide power to the socket of the computing device. The recessed channel 412 and power connector 410 may have similar features and functions to the recessed channel 108 and power connector 110 described above with respect to FIGS. 1A, 1B, and 1C.

FIG. 4B shows the height 407 of the circular plug 400. The height 407 may be measured from a top 415 of the circular plug 400 to a bottom 417 of the circular plug 400.

Figure 4C:
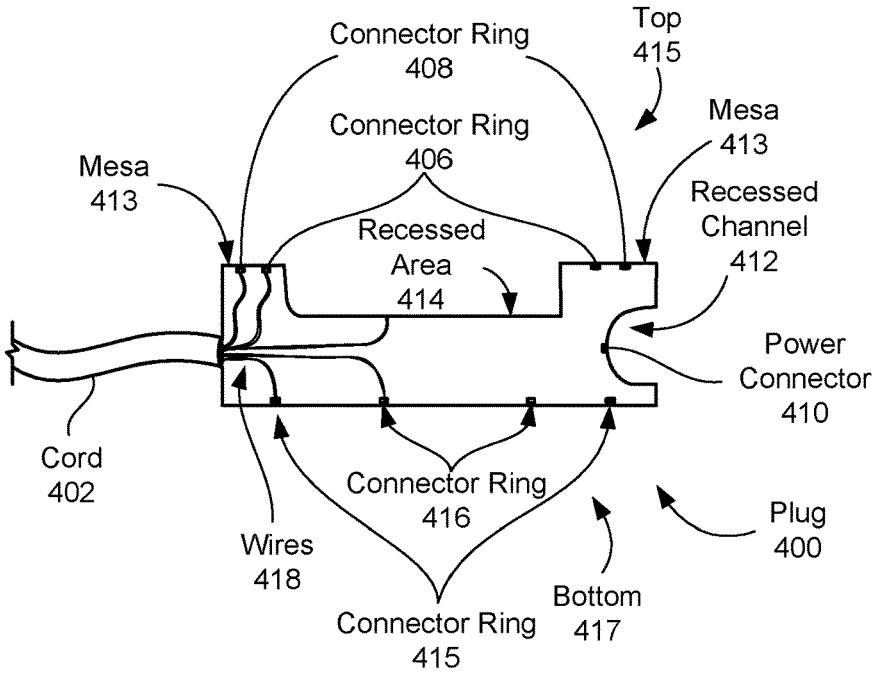
FIG. 4C is a side cut-away view of the plug shown in FIGS. 4A and 4B according to an example embodiment.

FIG. 4C is a side cut-away view of the plug 400 shown in FIGS. 4A and 4B according to an example embodiment. In this example, the retention feature 404 (labeled in FIG. 4A) includes a recessed area 414, surrounded by a mesa 413 which may receive a biased member from the socket. FIG. 4C also shows the circular connector rings 406, 408. The recessed channel 412, which is on a front and sides of the plug 400, protects the power connector 410.

In this example, the plug 400 may also include one or more connector rings 415, 416 on a bottom 417 or opposite side of the plug 400 from the connector rings 406, 408. The connector ring(s) 415, 416 may be circular and may, for example, couple to ground. The plug 400 may also include wires 418 coupled to the connector rings 406, 408, 415, 416, power connector 410. The wires 418 may extend through the cord 402 and couple the connector rings 406, 408, 415, 416 and power connector 410 to another electrical device or power source.

Figure 5:
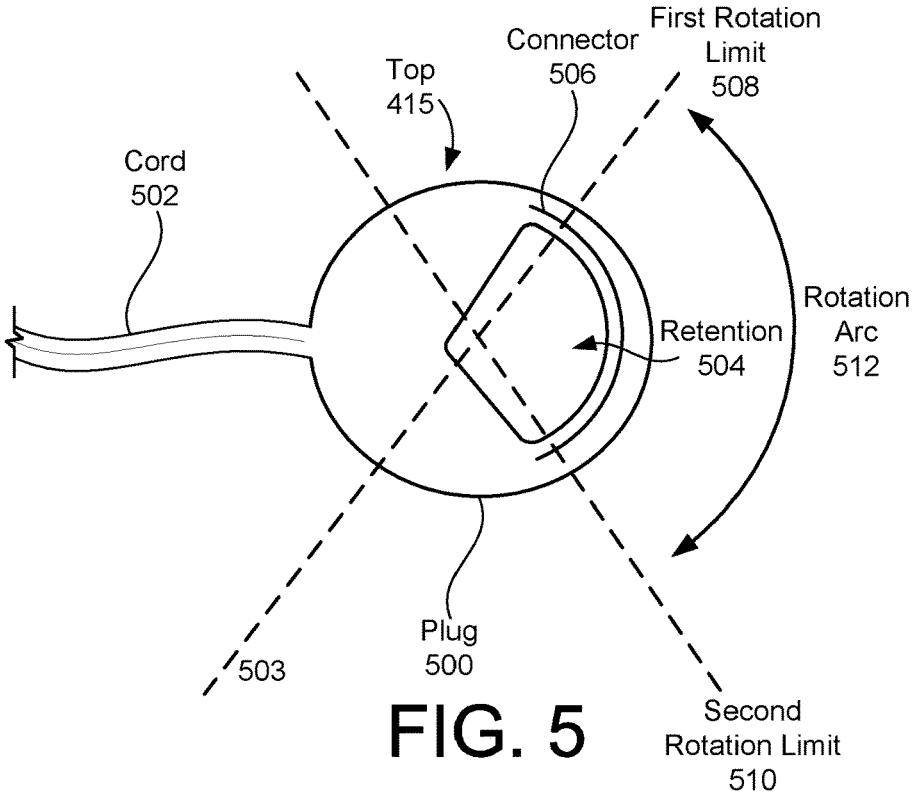
FIG. 5 shows a top view of a rounded plug in an example in which the retention feature is semi-circular according to an example embodiment.

FIG. 5 shows a top view of a rounded plug 500 in an example in which the retention feature 504 is semi-circular according to an example embodiment. In this example, the retention feature 504, which may include a recessed area and mesa similar to the recessed areas 104, 414 and mesas 119, 413 described above, is semi-circular, allowing a limited degree of rotation of the plug 500 within a socket. The plug 500 may include a connector 506 which is also semi-circular, corresponding to the degree of rotation of the retention feature 504. The connector 506 may couple to a connector of the socket while the plug 500 rotates within the socket within the range of motion allowed by the retention feature 504. The limited conductive area on the connector 506, which has an arc shape rather than a full circle, reduces the possibility of the connector 506 accidentally contacting conductive materials and short-circuiting the plug 500.

The semicircular retention feature 504 may cause the plug 500 to have a first rotation limit 508 corresponding to the first edge of the retention feature 504 and a second rotation limit 510 corresponding to another edge of the retention feature 504. An angle between the first rotation limit 508 and the second rotation limit 510 may define a rotation arc 512. The rotation arc 512 may show the limits of rotation of the plug 500 within the socket. The rotation arc 512 may, for example, be less than ninety degrees and greater than forty-five degrees.

Figure 6A:
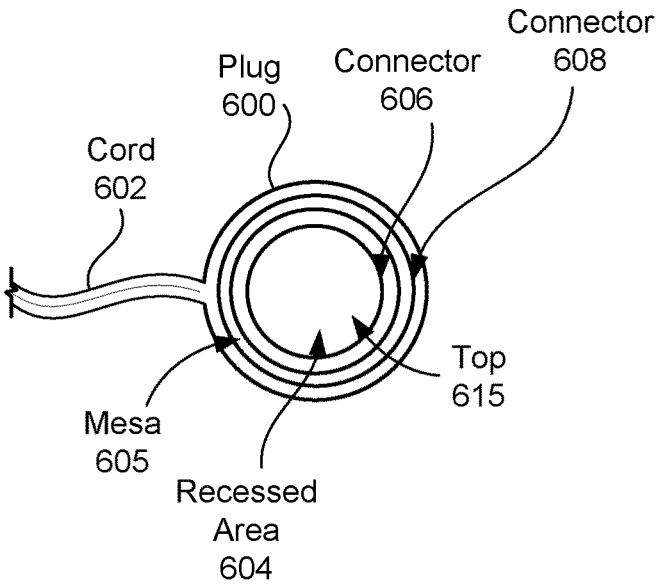
FIG. 6A is a top view of a rounded plug according to an example embodiment.

FIG. 6A is a top view of a rounded plug 600 according to an example embodiment. In this example, the plug 600 may include a recessed area 604 surrounded and/or defined by a mesa 605. The plug 600 may be connected to a cord 602 which has electrical wires carrying power and/or signals. The plug 600 may include a connector 606 within the recessed area 604. The connector 606 may couple to a connector of the socket and transmit electrical power and/or data. The plug 600 may also include a connector 608 on the mesa 605. The connector 608 may couple to another connector of the socket and transmit electrical power and/or data. In this example, either or both of the connectors 606, 608 may include pins or pads, and may be biased, such as by springs, to improve electrical coupling with contacts of the socket.

Figure 6B:
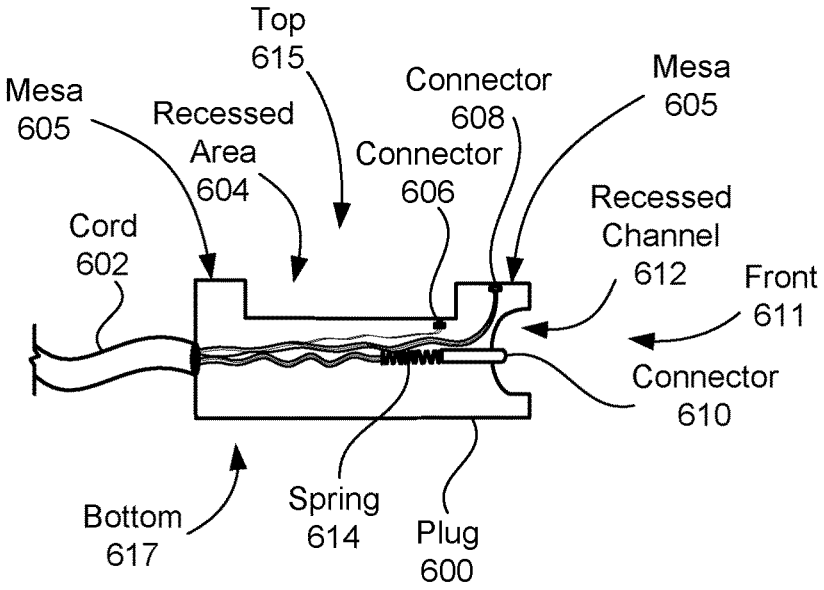
FIG. 6B is a side cut-away view of the plug shown in FIG. 6A according to an example embodiment.

FIG. 6B is a side cut-away view of the plug 600 shown in FIG. 6A according to an example embodiment. In this example, the connector 606 may be included in the recessed area 604, and the connector 608 may be included in the mesa 605 surrounding the retention feature 604.

In this example, the plug 600 may also include a recessed channel 612. The recessed channel 612 may extend around all or part of a front or sides of the plug 600 The plug 600 may include an electrical connector 610 in and extending from the recessed channel 612. The plug 600 may include a spring 614 which biases the connector 610 outward into the recessed channel 612. The spring 614 may assist the connector 610 to couple to a connector within the socket.

Figure 7A:
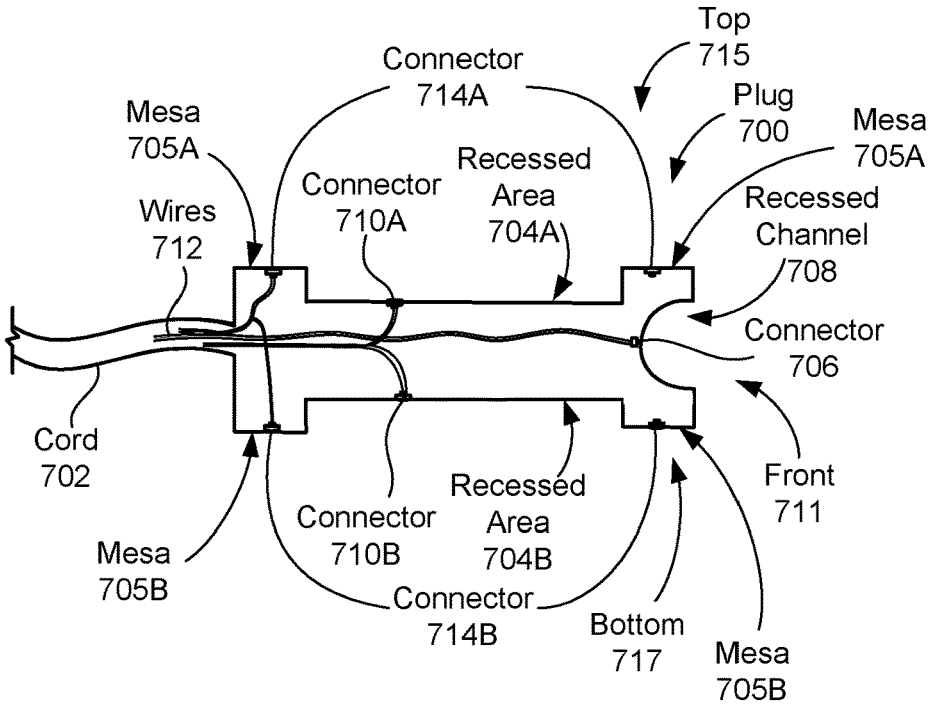
FIG. 7A is a diagram showing a side cut-away view of a rounded plug in an example in which the plug includes rounded connectors on the upraised portion of the plug, surrounding the retention feature according to an example embodiment.

FIG. 7A is a diagram showing a side cut-away view of a rounded plug 700 in an example in which the plug 700 includes rounded connectors 714A, 714B on the upraised mesas 705A, 705B surrounding and/or defining of the recessed areas 704A, 704B according to an example embodiment.

In this example, the plug 700 may be symmetrical, with a top 715 of the plug 715 having a similar shape and features to a bottom 717 of the plug 700, allowing the plug 700 to be turned upside down and still inserted into the same socket, or the plug 700 may not be symmetrical with one mesa 705A, 705B and/or recessed area 704A, 704B being higher or deeper than the other. The plug 700 may include connectors 714A, 714B which are circular on the respective mesas 705A, 705B. In a symmetrical embodiment, the connectors 710A, 710B may be coupled to each other, and the connectors 714A, 714B may be coupled to each other.

The plug 700 may also include a recessed channel 708 in a front 711 and sides of the plug 700, and a connector 706 in the recessed channel 708, similar to the connector and recessed channel in the example plugs described above.

Figure 7B:
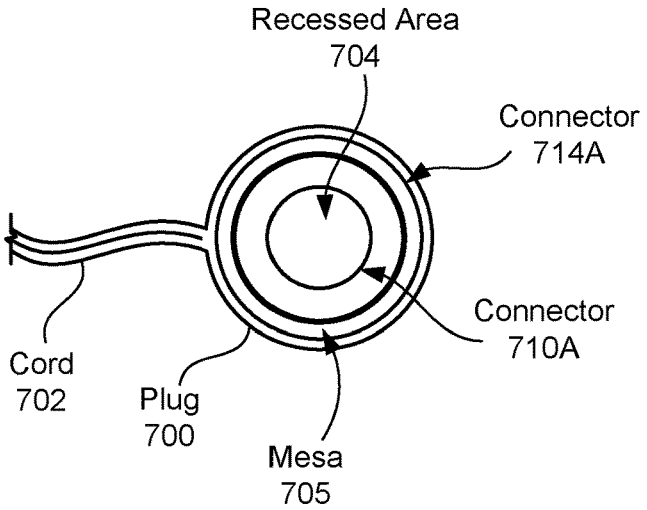
FIG. 7B is a top view of the plug shown in FIG. 7A according to an example embodiment.

FIG. 7B is a top view of the plug 700 shown in FIG. 7A according to an example embodiment. In this example, the connector 710A is circular, within the circular recessed area 704A.

Figure 7C:
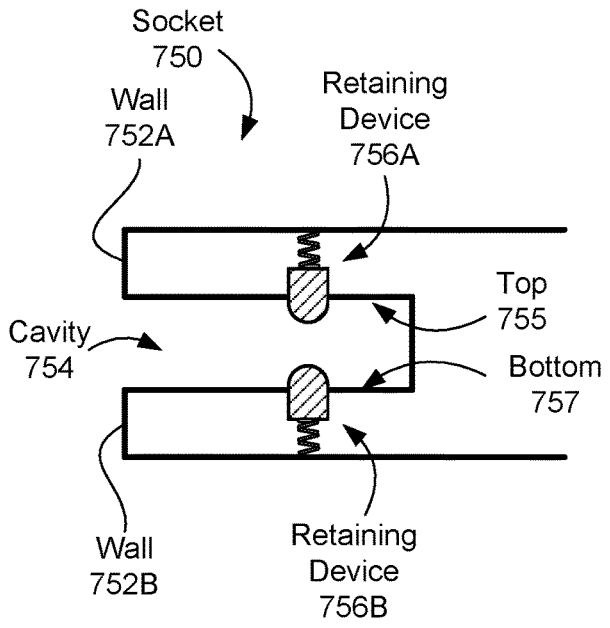
FIG. 7C shows a side cut-away view of a socket designed to receive the plug of FIGS. 7A and 7B according to an example embodiment.

FIG. 7C shows a side cut-away view of a socket 750 designed to receive the plug 700 of FIGS. 7A and 7B according to an example embodiment. In this example, the socket 750 may include retaining devices 756A, 756B on a top 715 and bottom 717 of the socket 750. The retaining devices 756A, 756B may be biased to extend into a cavity 754 of the socket 750. The cavity 754 of the socket 750 may be defined by walls 752A, 752B. The retaining devices 756A, 756B may be biased to extend into the cavity 754 and thereby engage the retention features 704A, 704B of the plug 700. The retaining devices 756A, 756B may or may not serve as connectors which receive power and/or signals from connectors of the plug 700.

Figure 7D:
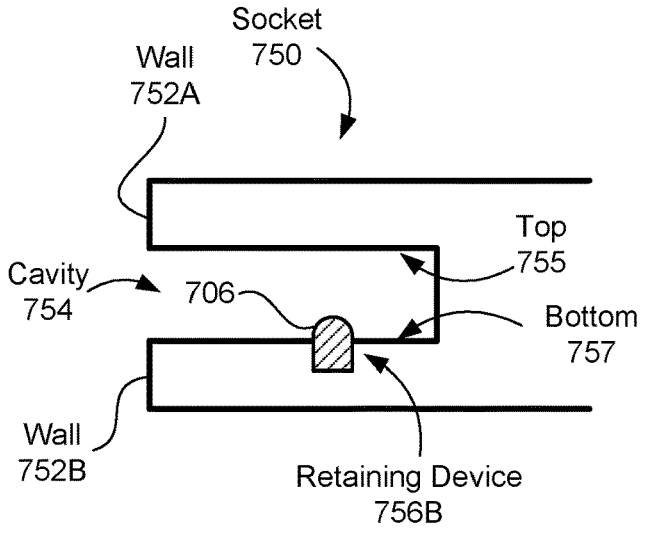
FIG. 7D is another example of a socket configured to receive the plug shown in FIGS. 7A and 7B according to an example embodiment.

FIG. 7D is another example of a socket 750 configured to receive the plug 700 shown in FIGS. 7A, 7B according to an example embodiment. In this example, the socket 750 includes a single retaining device 756B. The single retaining device 756B may couple to one retention feature 704A, 704B of the plug 700. The single retaining device 756B may include a connector and may work in an example in which the connectors 710A, 710B of the plug 700 are connected to a same node and thereby render irrelevant which connector 710A, 710B couples to the retaining device 756B.

Figure 8:
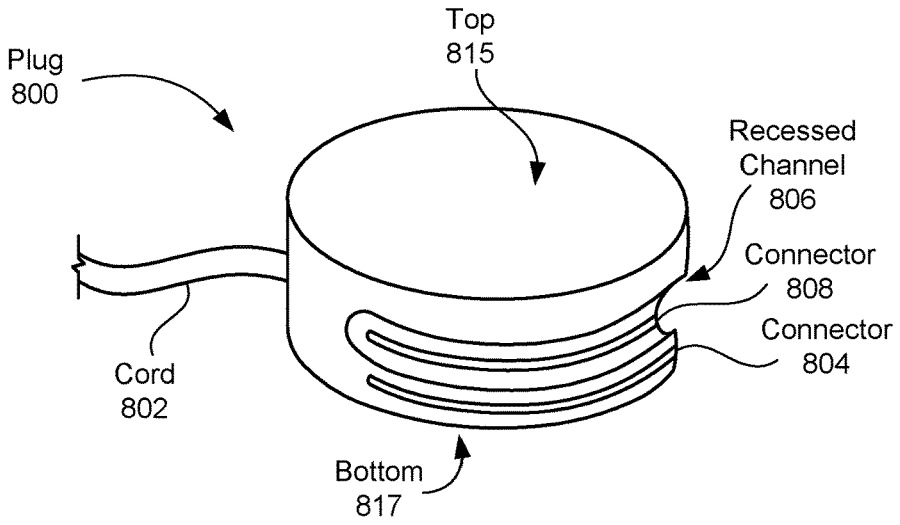
FIG. 8 shows a plug in an example in which the plug includes two front connectors according to an example embodiment.

FIG. 8 shows a plug 800 in an example in which the plug 800 includes two front connectors 804, 808 according to an example embodiment. The plug 800 may be coupled to a cord 802 which includes one or more electrical wires. The plug 800 may include a recessed channel 806, extending around an outer perimeter of the plug 800, which protects the connector 808. The plug 800 may also include a connector 804 which is on an upraised portion, lip, or ridge adjacent to the recessed channel 806.

The connector 804 may not be protected in the same manner the connector 808 is protected by the recessed channel 806. The connector 804 may, for example, be a ground node that does not need to be protected. The connector 804 may be closer to a bottom 812 of the plug 800, whereas the recessed channel 806 and connector 808 may be closer to a top 810 of the plug 800. The location of the connector 804 outside the recessed channel 806 may cause external devices to contact the connector 804 before contacting the connector 808.

Figure 9A:
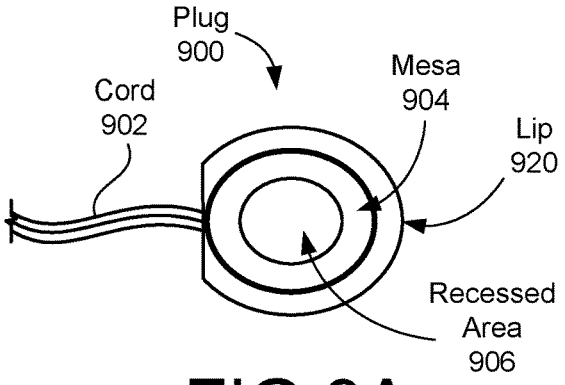
FIG. 9A shows a rounded plug according to an example embodiment.

FIG. 9A shows a rounded plug 900 according to an example embodiment. The plug 900 may be coupled to a cord 902 which includes at least one electrical wire. The plug 900 may include a retention feature, which may include a recessed area 906 which receives an extruding retention feature from the socket, and a mesa 904 surrounding the recessed area 906, similar to the plug 100 described above. The plug 900 may also include a lip 920. The lip 920 may extend beyond other portions of the plug 900.

Figure 9B:
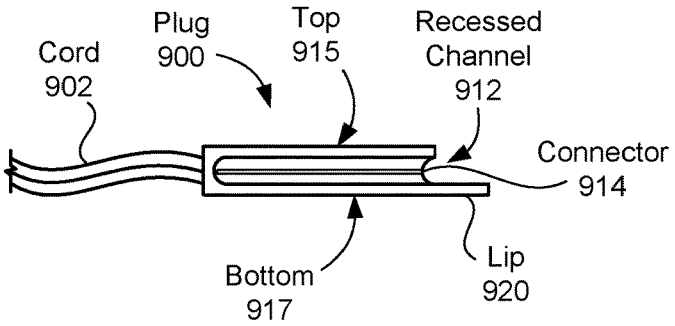
FIG. 9B is a side view of the plug shown in FIG. 9A according to an example embodiment.

FIG. 9B is a side view of the plug 900 shown in FIG. 9A according to an example embodiment. In this example, the plug 900 may include a recessed channel 912 which protects a power connector 914. The recessed channel 912 may extend around a front and sides of the plug 900. The power connector 914 may extend along the recessed channel 912. A bottom 917 of the plug 900 may be wider, longer, and/or have a greater area, radius, or surface area, than a top 915 of the plug 900. The asymmetrical shape of the plug 900 may prevent a user from inserting the plug 900 into a socket upside-down.

Figure 9C:
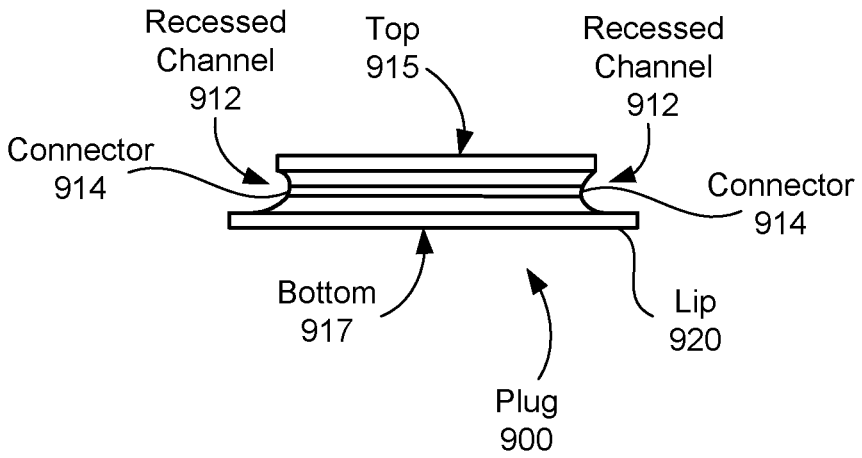
FIG. 9C is a front view of the plug shown in FIGS. 9A and 9B according to an example embodiment.

FIG. 9C is a front view of the plug 900 shown in FIGS. 9A, 9B according to an example embodiment. As shown in FIG. 9C, the bottom 917 of the plug 900 is longer, wider, and/or has greater area or surface area than the top 915 of the plug 900. The connector 914 may extend along a majority of the recessed channel 912.

Figure 9D:
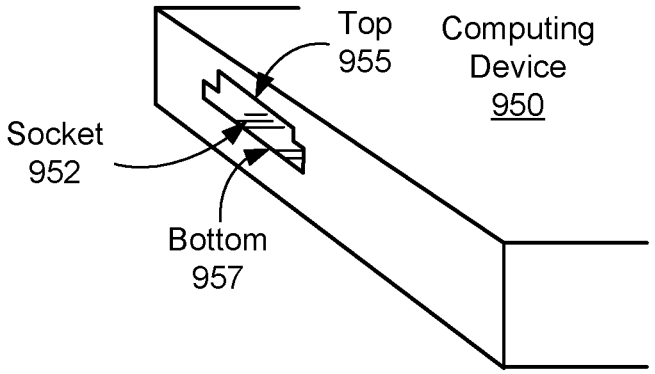
FIG. 9D is a diagram showing a computing device with a socket configured to receive the plug shown in FIGS. 9A, 9B and 9C according to an example embodiment.

FIG. 9D is a diagram showing a computing device 950 with a socket 952 configured to receive the plug 900 shown in FIGS. 9A, 9B and 9C according to an example embodiment. As shown in FIG. 9D, a bottom 957 of the socket 952 is wider or longer than a top 955 of the socket 952, allowing the socket 952 to receive the plug 900 shown in FIGS. 9A, 9B and 9C. The wider or longer bottom 957 of the socket 952 may prevent a user from inserting the plug 900 into the socket 952 upside-down.

Figure 10A:
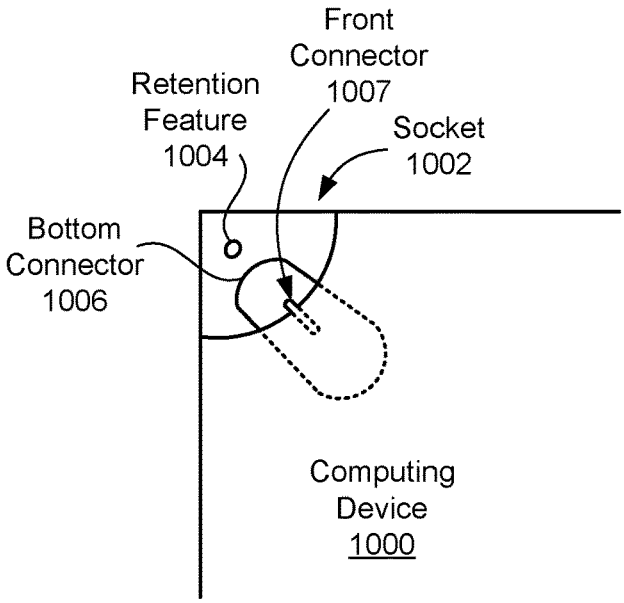
FIG. 10A is a diagram showing a top cut-away view of a computing device with a socket according to an example embodiment.

FIG. 10A is a diagram showing a top cut-away view of a computing device 1000 with a socket 1002 according to an example embodiment. In this example, the socket 1002 may be located in a corner of the computing device 1000, increasing a range of motion of a plug within the socket 1002. The socket 1002 may include a retention feature 1004 which is configured to engage the recessed retention feature of the plugs described above. The retention feature 1004 may include a biased component, such as a curved piece of metal or spring-loaded component, which extends into the socket 1002. The socket 1002 may also include the connector 1006 configured to engage the front connectors of the plugs described above, the front connectors being located in the recessed channels.

Figure 10B:
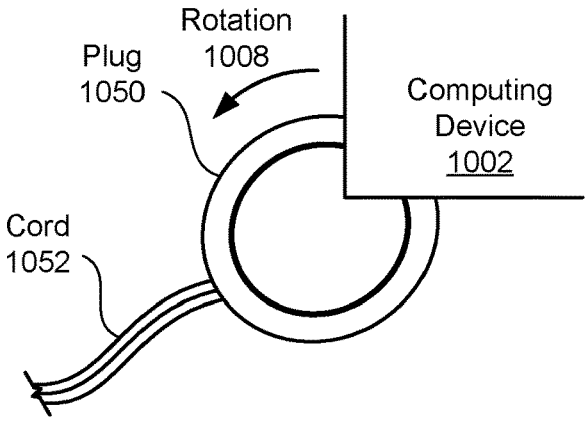
FIG. 10B is a diagram showing the plug partially or fully inserted into the socket of the computing device according to an example embodiment.

FIG. 10B is a diagram showing the plug 1050 partially or fully inserted into the socket (not labeled in FIG. 10C) of the computing device 1002 according to an example embodiment. The plug 1050 may rotate within the computing device 1002 in the direction of rotation 1008, or in an opposite direction. The retention feature 1004 (shown in FIG. 10A) of the computing device 1000, and a retention feature of the plug 1050, which may include a recessed area and mesa as described with respect to example plugs above, may allow the plug 1050 to rotate within the computing device 1000 while maintaining electrical coupling between the plug 1050 and the computing device 1000. The retention feature 1004 of the computing device 1000 and the retention feature of the plug 1050 may also allow the plug 1050 to fall out of the computing device 1000 without damaging either the plug 1050 or computing device 1000 or pulling the computing device 1000 off of a table if the cord 1052 is pulled on, such as if the cord 1052 is tripped over, as described above with respect to example plugs and computing devices.

Figure 11A:
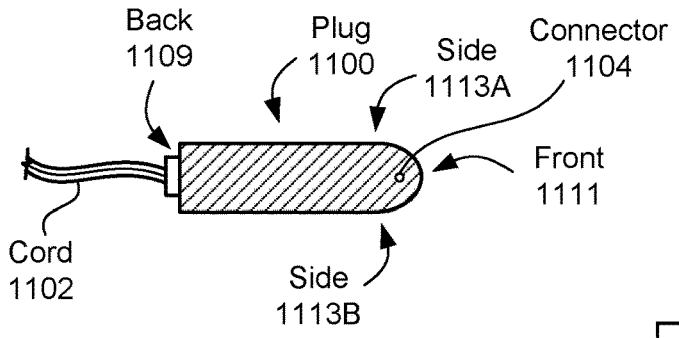
FIG. 11A is a diagram showing a plug in an example in which the plug will be smaller than the socket which receives the plug.

FIG. 11A is a diagram showing a plug 1100 in an example in which the plug 1100 will be smaller than the socket which receives the plug 1100. The smaller size of the plug 1100 relative to the socket increases a range of motion or rotation of the plug 1100 within the socket. The plug 1100 in this example is rectangular with a rounded front end 1111. The plug 1100 may, for example, have a relatively small thickness as measured in a direction facing the reader. A thickness may, for example, be less than one-half or one-fourth a width of the plug 1100. In this example, a back end 1109 of the plug 1100 is flat and connected to a cord 1102. The cord 1102 may include one or more electrical wires that carry power and/or signals. The sides 1113A, 1113B of the plug 1100 may form a cylinder, with the front end 1111 of the plug 100 forming a partial- or half-sphere placed onto the cylinder.

Figure 11B:
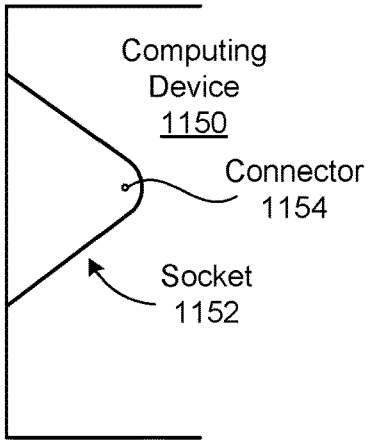
FIG. 11B is a diagram showing a top cut-away view of the computing device with the socket configured to receive the plug shown in FIG. 11A according to an example embodiment.

FIG. 11B is a diagram showing a top cut-away view of the computing device 1150 with the socket 1152 configured to receive the plug 1100 shown in FIG. 11A according to an example embodiment. In this example, the socket 1102 may be triangular with a rounded end. The rounded end may correspond to the rounded front 1111 of the plug 1100. The triangular shape of the socket 1152 may allow the plug 1100 to rotate and/or move within the socket 1152. The socket 1152 may include a connector 1154 that couples to an electrical connector of the plug 1100 and secures the plug 1100 within the socket 1152.

Figure 11C:
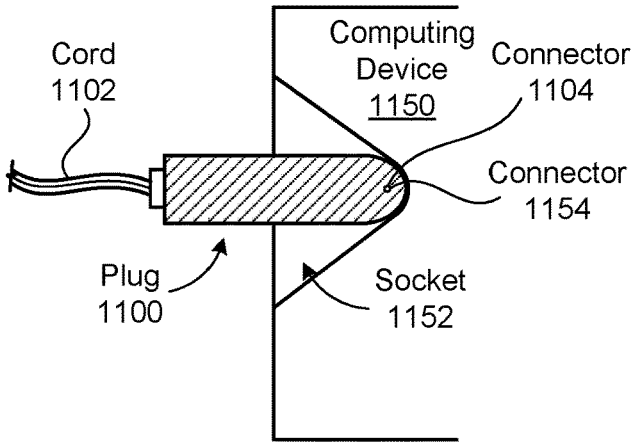
FIG. 11C is a diagram showing the plug within the socket according to an example embodiment.

FIG. 11C is a diagram showing the plug 1100 within the socket 1152 according to an example embodiment. In this example, the connector 1154 secures the plug 1100 within the socket 1152, while still allowing the plug 1100 to rotate within the socket 1152. The plug 1100 may, for example, include a recessed retention feature that receives the connector 1154.

Figure 11D:
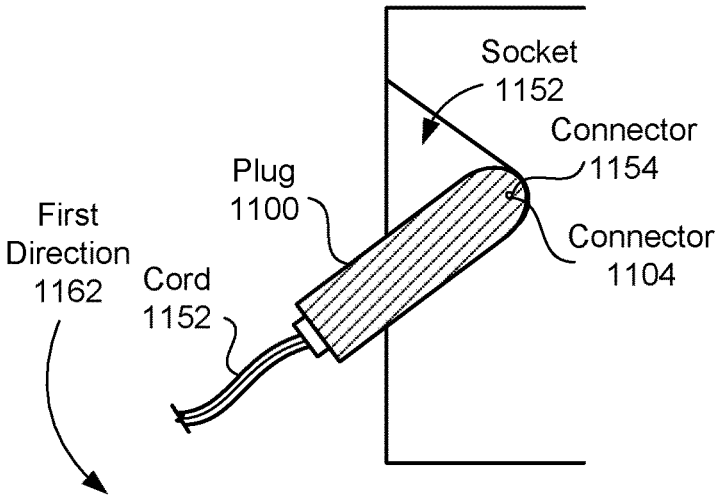
FIG. 11D is a diagram showing the plug rotated to the right within the socket according to an example embodiment.

FIG. 11D is a diagram showing the plug 1100 rotated to the right within the socket 1152 in a first direction 1162 according to an example embodiment. In this example, the position of the connector 1154 secures the end of the plug 1100 within the socket 1152.

Figure 11E:
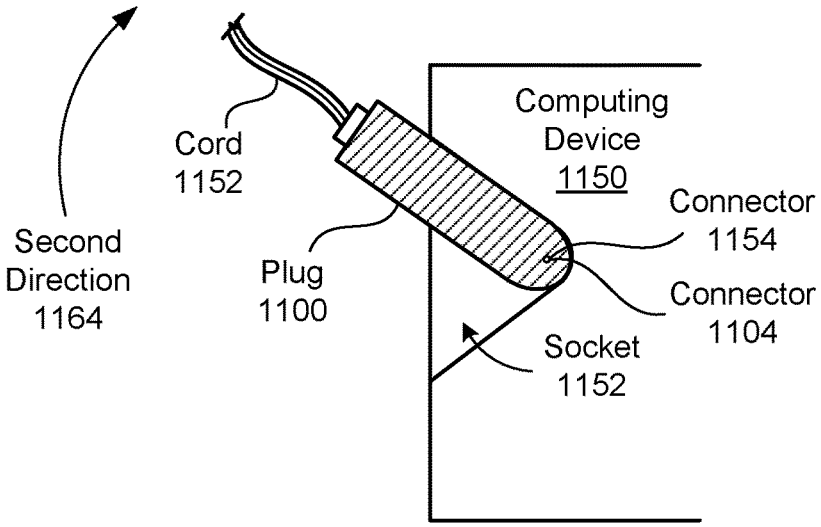
FIG. 11E is a diagram showing the plug rotated to the left within the socket according to an example embodiment.

FIG. 11E is a diagram showing the plug 1100 rotated to the left within the socket 1152 in a second direction 1164 according to an example embodiment. In this example, the plug 1100 has rotated to the left within the socket 1152. The connector 1154 has still secured the plug 1100 within the socket 1152. FIGS. 11C, 11D and 11E show the rotation of the plug 1100 within the socket 1152 with the connector 1154 still securing the plug 1100 within the socket 1152.

Figure 12A:
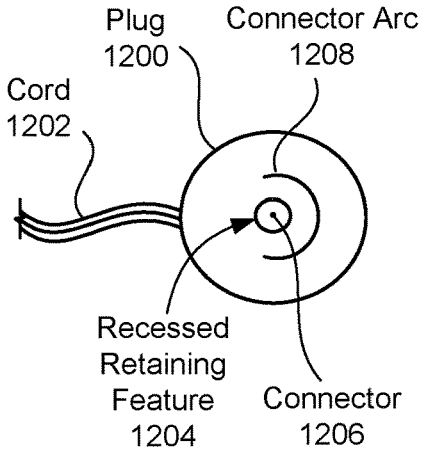
FIG. 12A is a diagram showing a rounded plug according to an example embodiment.

FIG. 12A is a diagram showing a rounded plug 1200 according to an example embodiment. The rounded plug 1200 may be circular. The plug 1200 may be connected to a cord 1202 which includes one or more electrical wires that carry electrical power and/or signals.

The plug 1200 may include a recessed retaining feature 1204. The recessed retaining feature 1204 may include a rounded aperture or a hole. A connector 1206 may be at or near a bottom of the recessed retaining feature 1204. The plug 1200 may include a connector arc 1208. The connector arc 1208 may include a conductive material in a semicircular arc (which can be referred to as a semicircular connector arc) or other rounded shape in the plug 1200. The connector arc 1208 and connector 1206 may couple to connectors of the socket and transmit and/or receive power and/or electrical signals.

Figure 12B:
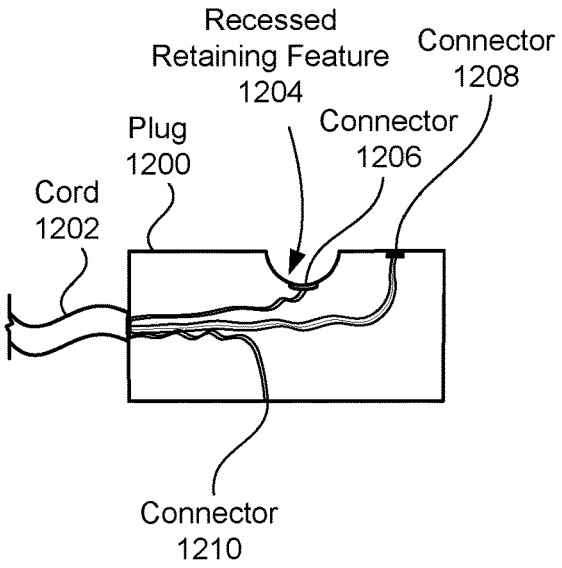
FIG. 12B is a side cut-away view of the plug shown in FIG. 12A according to an example embodiment.

FIG. 12B is a side cut-away view of the plug 1200 shown in FIG. 12A according to an example embodiment. As shown in FIG. 12B, the connector 1206 is at or near a bottom of the rounded, concave, and/or recessed retaining feature 1204. As shown in FIG. 12B, the connector arc 1208 is on an upraised portion of the plug 1200 near the recessed retaining feature 1204.

In this example, the plug 1200 may also include another connector 1210 on a bottom portion or opposite portion of the plug 1200 from the recessed retaining feature 1204, connector 1206 and connector 1208. The connector 1210 may, for example, be a ground connector.

Figure 12C:
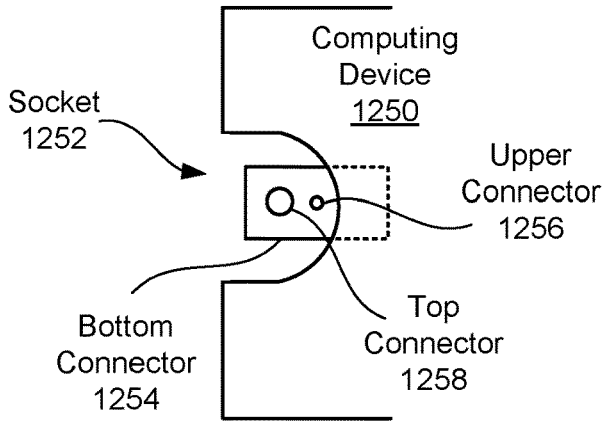
FIG. 12C is a diagram showing a top cut-away view of a computing device with the socket configured to receive the plug shown in FIGS. 12A, 12B according to an example embodiment.

FIG. 12C is a diagram showing a top cut-away view of a computing device 1250 with the socket 1252 configured to receive the plug 1200 shown in FIGS. 12A, 12B according to an example embodiment. In this example, the socket 1252 is rounded or semi-circular to receive the plug 1200. The socket 1252 may include a bottom connector 1254 to engage the connector 1210 of the plug 1200. The socket 1252 may include an upper connector 1256 to engage the connector 1208 of the plug 1200. The socket 1252 may also include a top connector 1258 to engage the connector 1206 of the plug 1200.

Figure 12D:
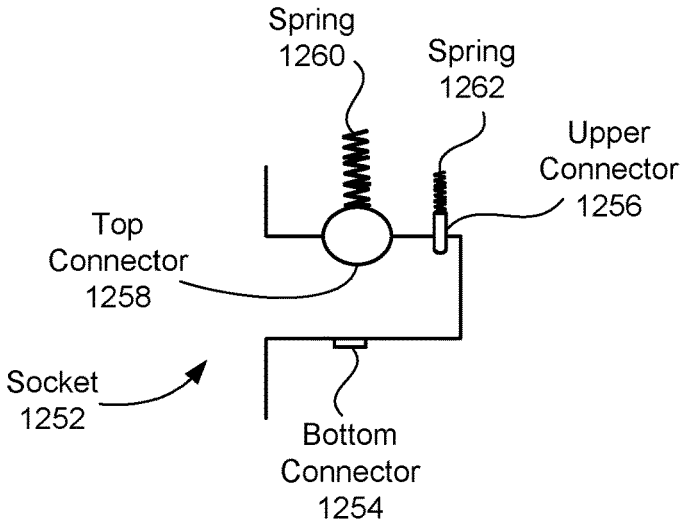
FIG. 12D is a side cut-away view of the socket shown in FIG. 12C according to an example embodiment.

FIG. 12D is a side cut-away view of the socket 1252 shown in FIG. 12C according to an example embodiment. In this example, the top connector 1258 may include a ball-shaped device. The top connector 1258 may be made of a conductive material such as metal. The socket 1252 may include a spring 1260. The spring 1260 may bias the top connector 1258 into the socket 1252 to engage the connector 1206 and/or to secure the top connector 1258 within the recessed retaining feature 1204, thereby securing the plug 1200 within the socket 1252.

The socket 1252 may also include a spring 1262. The spring 1262 may bias the upper connector 1256 into the socket 1252 to engage the connector 1208. The upper connector 1256 may include a pin or rod-shaped device, and/or may extend into the socket 1252 a shorter distance than the top connector 1258. In this example, the top connector 1258 may contact the connector 1206 only when the plug 1200 is fully inserted into the socket 1252.

Figure 13A:
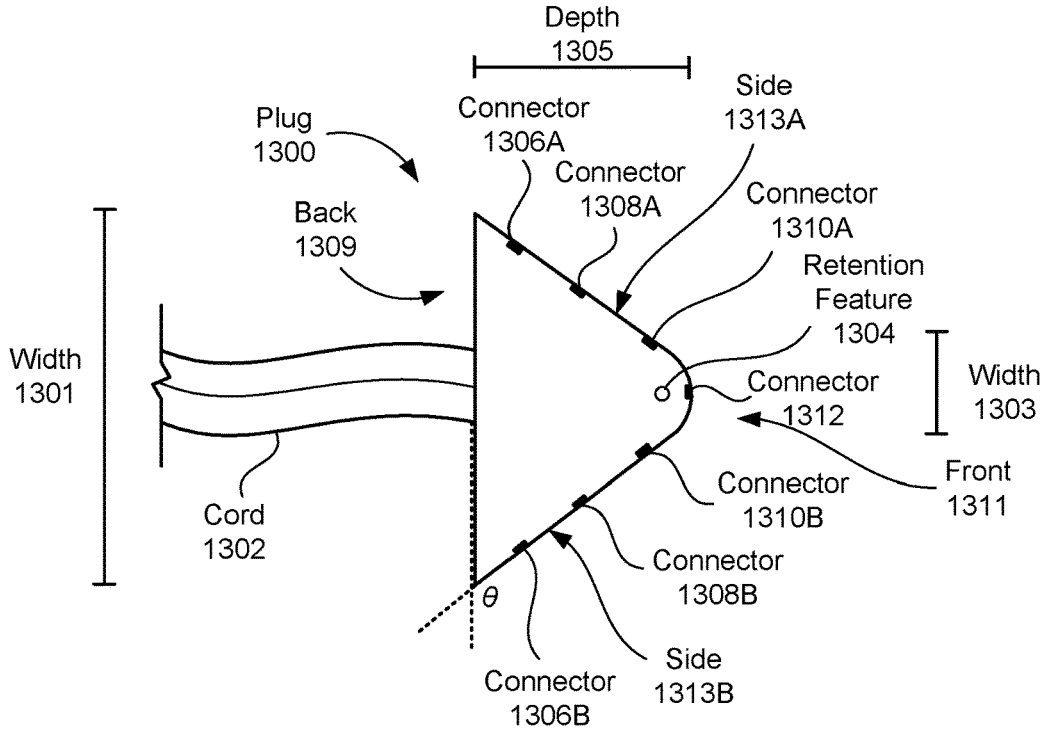
FIG. 13A is a diagram showing a top view of a triangular plug according to an example embodiment.

FIG. 13A is a diagram showing a top view of triangular plug 1300 according to an example embodiment. The triangular plug 1300 may not rotate within a socket without breaking contact with the contacts in the socket. The prevention of rotation may allow a greater number of connectors, because the fixed positioning of the plug 1300 within the socket may ensure that specific connectors in the plug 1300 contact specific connectors in the socket.

The triangular plug 1300 may be connected to a cord 1302. The cord 1302 may be connected to a back 1309 of the plug 1300. The plug 1302 may include one or more, or multiple, electrical wires which may carry electrical power and/or signals.

The plug 1300 may include a retention feature 1304. The retention feature 1304 may include a recessed portion configured to receive a retention member of the socket, which may include a biased member which extends into the socket and into the retention feature 1304, securing the plug 1300 within the socket.

The plug 1300 may also include a plurality of connectors 1306A, 1306B, 1308A, 1308B, 1310A, 1310B, 1312. The connectors 1306A, 1306B, 1308A, 1308B, 1310A, 1310B, 1312 may be included in a recessed channel (shown in FIG. 13B) and protected from contact. The connectors 1306A, 1306B, 1308A, 1308B, 1310A, 1310B, 1312 may be coupled to the at least one electrical wire in the cord 1302, and may couple to connectors in the socket, transmitting electrical power and/or signals to the computing device. In an example in which the plug 1300 is symmetrical, and can be turned upside down and inserted into the socket without change of functionality, connector 1306A and connector 1306B may be coupled to a common node, connector 1308A and connector 1308B may be coupled to a common node, and connector 1310A and connector 1310B may be coupled to a common node.

The plug 1300 may have a width 1301 measured along a back 1309 of the plug 1300. The plug 1300 may also have a width 1303 measured along a front 1311 or from opposite sides of the plug 1300. The width 1303 may decrease toward the front 1311 as a result of the tapered shape of the plug 1300.

The plug 1300 may have a depth 1305 measured from the back 1309 of the plug 1300 to the front 1311 of the plug 1300. The width 1301 along the back 1309 of the plug 1300 may be as great as or greater than the depth 1305 of the plug 1300. The width 1301 along the back 1309 of the plug 1300 may, for example, be at least twice the depth 1305 of the plug 1300.

An angle Θ may be measured based on an intersection between a plane extending along the back 1309 of the plug 1300 and a plane extending along either side 1313A, 1313B of the plug 1300. The plug 1300 may be in a form of an isosceles triangle, rendering the angles Θ of the planes of intersection of both sides 1313A, 1313B and the back 1309 approximately equal to each other. The angle Θ may be greater than ninety degrees, reflecting the inward taper of the sides 1313A, 1313B compared to a line extending normally from an edge of the socket into which the plug 1300 is inserted. The sides 1313A, 1313B may, for example, have approximately equal lengths.

Figure 13B:
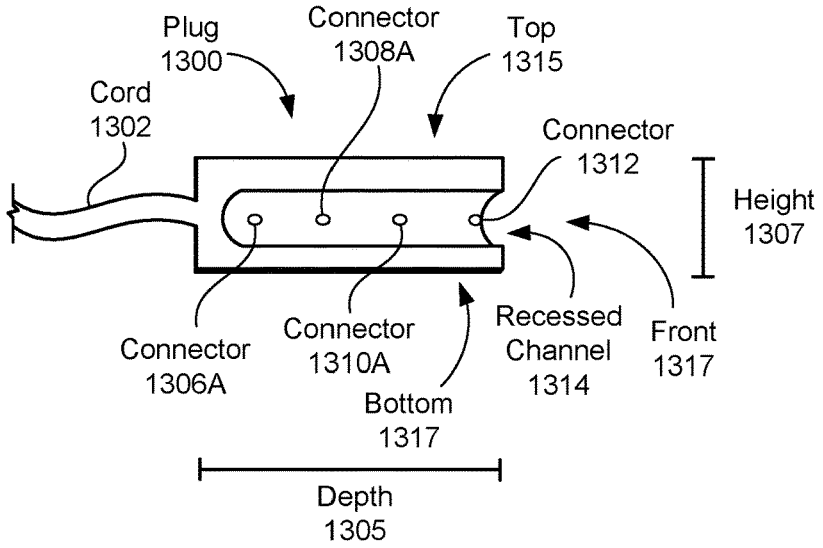
FIG. 13B is a side view of the plug according to an example embodiment.

FIG. 13B is a side view of the plug 1300 according to an example embodiment. FIG. 13B shows the recessed channel 1314 along one side 1313B that protects the connectors 1306A, 1308A, 1310A, 1312 and, while not shown, connectors 1310B, 1308B, 1306B. The recessed channel 1314 may extend along one side 1313B, across the front 1311, and along the other side 1313A.

FIG. 13B shows a height 1307 of the plug 1300. The height 1307 may be measured from a top 1315 of the plug 1300 to a bottom 1317 of the plug 1300. The height 1307 may be less than either the depth 1305 of the plug 1300 or the width 1301 along the back 1309 of the plug 1300. In an example embodiment, the width 1301 along the back 1309 of the plug 1300 and/or the depth 1305 of the plug 1300 may be at least twice, at least three times, at least four times, or at least five times the height 1307 of the plug 1300.

In an example implementation, the recessed channel 1314 may include two or more rows of connectors in addition to the connectors 1306A, 1306B, 1308A, 1308B, 1310A, 1310B, 1312 shown in FIGS. 13A and 13B. The additional connectors and/or rows of connectors may support a greater number of signals, such as twenty or more signals to support High-Definition Multimedia Interface (HDMI) or DisplayPort. In an example embodiment, multiple rows of connectors may support multiple channels, with each row of connectors being dedicated to a single channel.

Figure 13C:
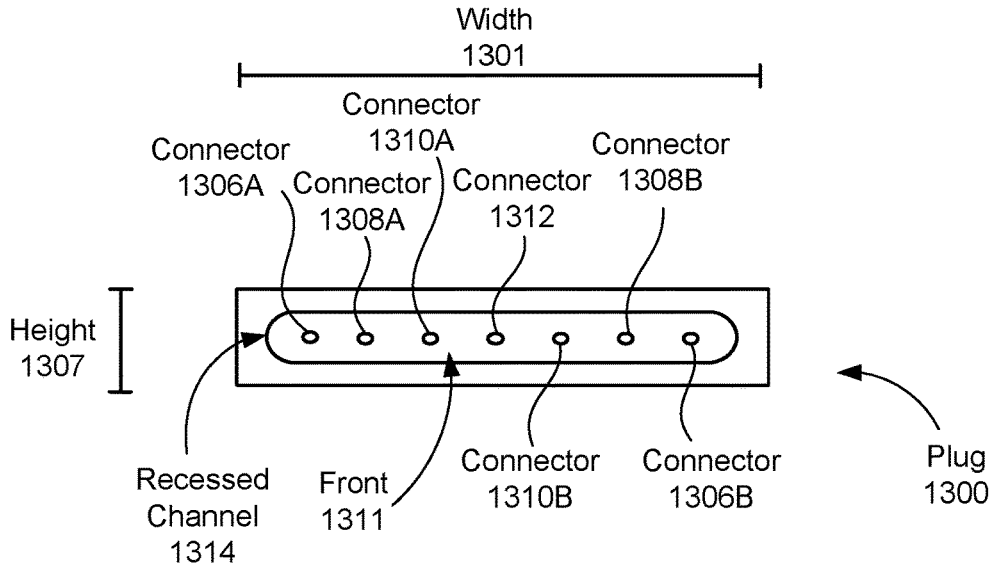
FIG. 13C is a front view showing the plug according to an example embodiment.

FIG. 13C is a front view showing the plug 1300 according to an example embodiment. In this view, the plug 1300 includes the recessed channel 1314, which includes the connectors 1306A, 1308A, 1310A, 1312, 1310B, 1308B, 1306B, extending along the front 1311 and the sides 1313A, 1313B of the plug 1300.

Figure 13D:
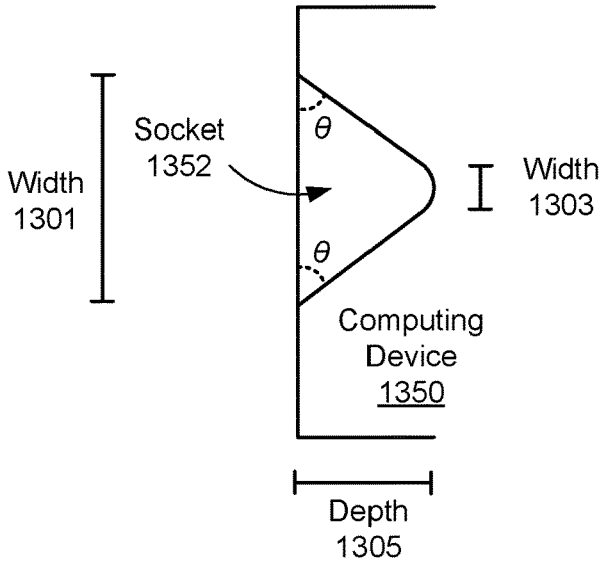
FIG. 13D is a diagram showing a top cut-away view of a computing device including a socket configured to receive the plug shown in FIGS. 13A, 13B, 13C according to an example embodiment.

FIG. 13D is a diagram showing a top cutaway view of a computing device 1350 including a socket 1352 configured to receive the plug 1300 shown in FIGS. 13A, 13B, 13C according to an example embodiment. In this example, the socket 1352 is triangular and corresponds in shape to the plug 1300. The socket 1352 may have a width 1301 at an opening of the socket 1352 that is approximately the same as, or slightly larger than, the width 1301 along the back 1309 of the plug 1300, allowing the plug 1300 to be fully inserted into the socket 1352. The socket 1352 may also have a width 1303 at a back of the socket 1352 that is approximately the same as, or slightly larger than, the width 1303 of the front 1311 of the plug 1300, allowing the socket 1352 to receive the plug 1300. The socket 1352 may also have a depth 1305 approximately the same as the depth 1300 of the plug 1300, allowing the socket 1352 to receive the plug 1300.

The sides of the socket 1352 may also form angles Θ with the side of the computing device 1350 into which the socket 1352 opens. The socket 1352 may be in the form of an isosceles triangle, rendering the two angles Θ approximately equal. The angles Θ in the socket 1352 may be equal to one-hundred and eighty degrees minus the angles Θ on the plug 1300.

Figure 13E:
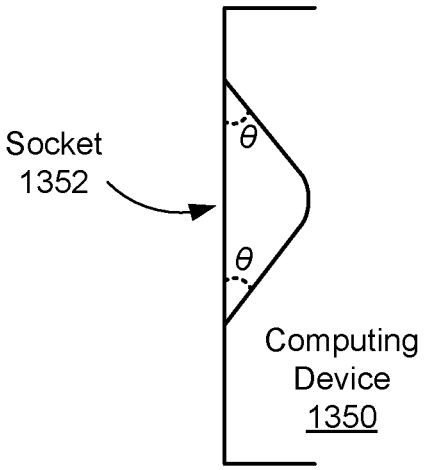
FIG. 13E is a diagram showing a top cut-away view of a computing device including the socket according to another example embodiment.

FIG. 13E is a diagram showing a top cutaway view of a computing device including the socket 1352 according to another example embodiment. While the socket 1352 is shown in FIG. 13D had angles Θ of forty-five degrees or less, the socket 1352 shown in FIG. 13E is obtuse, and has angles less than forty-five degrees. The socket 1352 could accommodate a plug 1300 with angles Θ greater than one-hundred and thirty-five degrees.

Figure 13F:
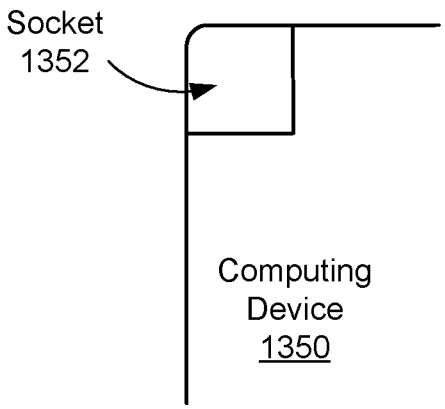
FIG. 13F shows a top cut-away view of a computing device with the socket on a corner of the computing device according to an example embodiment.

FIG. 13F shows a top cutaway view of the computing device 1350 with the socket 1352 on a corner of the computing device 1350 according to an example embodiment. In this example, the socket 1352 may receive a triangular or diamond-shaped plug 1300 within the corner of the computing device 1350.

Figure 14A:
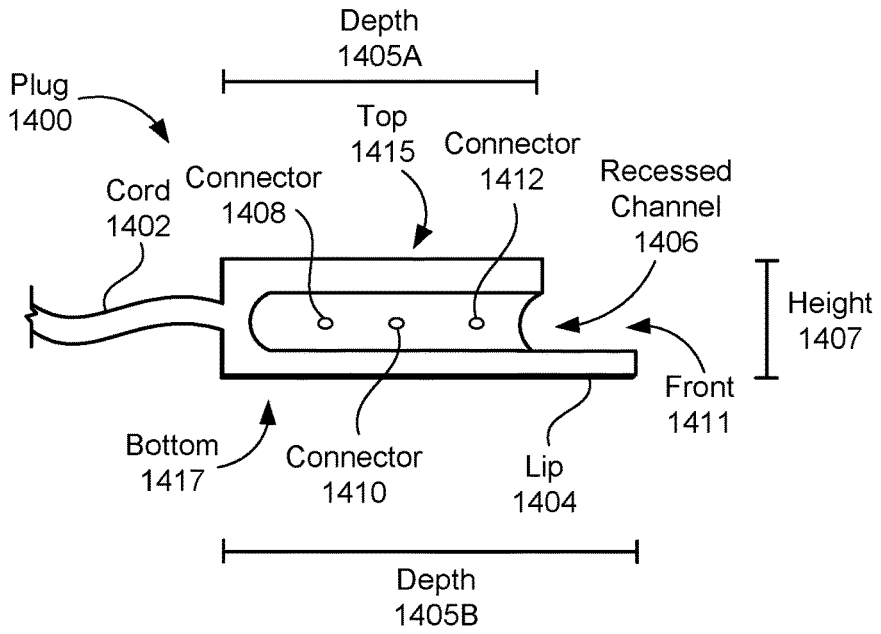
FIG. 14A shows a plug in an example in which a top of the plug is smaller than a bottom of the plug according to an example embodiment.

FIG. 14A shows a plug 1402 in an example in which a top 1415 of the plug 1402 is smaller than a bottom 1417 of the plug 1400 according to an example embodiment. The top 1415 may have a smaller surface area than the bottom 1417. In this example, the plug 1400 may be connected to a cord 1402. The cord 1402 may include one or more electrical wires which carry electrical power and/or signals.

The plug 1400 may include a recessed channel 1406. The recessed channel 1406 may extend around sides and a front 1411 of the plug 1400. The recessed channel 1406 may include and protect connectors 1408, 1410, 1412. The plug 1400 may include connectors on both sides of the plug 1400 through the recessed channel 1406, and the connectors may be insulated from each other, allowing the connectors to carry distinct signals. The plug 1400 may also include a lip 1404 on the bottom 1417 of the plug 1400. The lip 1404 may extend beyond the recessed channel 1406 a greater distance than the top 1415 of the plug 1400 extends beyond the recessed channel 1406. The lip 1404 may render the plug 1400 asymmetrical from top 1415 to bottom 1417, preventing a user from inserting the plug 1400 into a socket upside-down.

The plug 1400 may have a top depth 1405A measured from a back of the top 1415 to a front of the top 1415. The plug 1400 may also have a bottom depth 1405B measured from a back of the bottom 1417 to a front of the bottom 1417. The bottom depth 1417 may be greater than the top depth 1415. The plug 1400 may also have a height 1407 measured from the top 1415 of the plug 1400 to the bottom 1417 of the plug 1400. Both the top depth 1405A and bottom depth 1405B may be greater than the height 1407, and may be at least twice, at least three times, at least four times, or at least five times the height 1407 of the plug 1400.

Figure 14B:
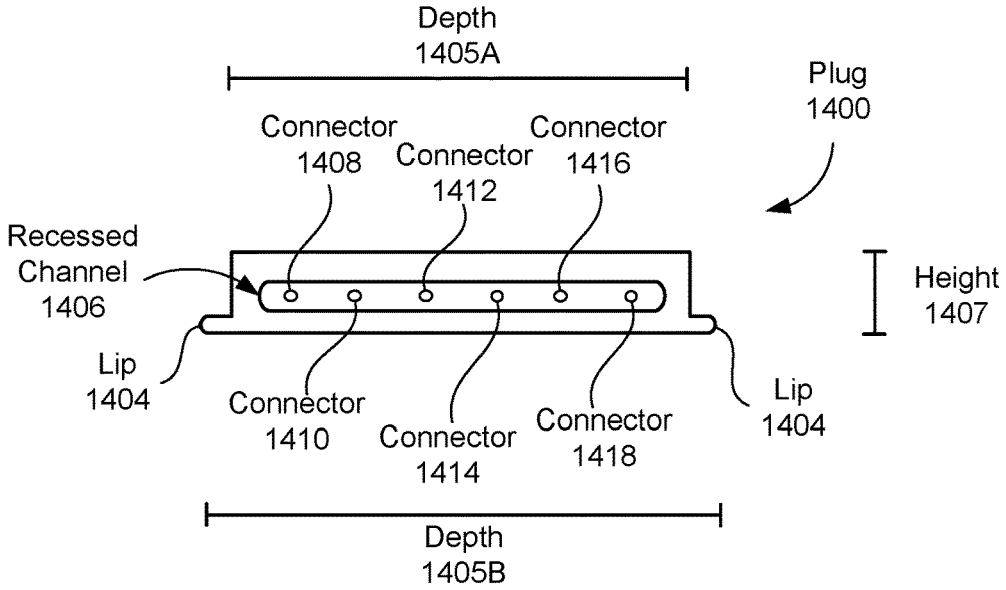
FIG. 14B is a front view of the plug shown in FIG. 14A according to an example embodiment.

FIG. 14B is a front view of the plug 1400 shown in FIG. 14A according to an example embodiment. As shown in FIG. 14B, the lip 1404 extends beyond the recessed channel 1406 and farther than the top portion of the plug 1400. In this example, because the plug 1400 is not symmetrical, the connectors 1408, 1410, 1412, 1414, 1416, 1418 may all be wired separately, which may facilitate transmitting multiple separate signals.

Figure 14C:
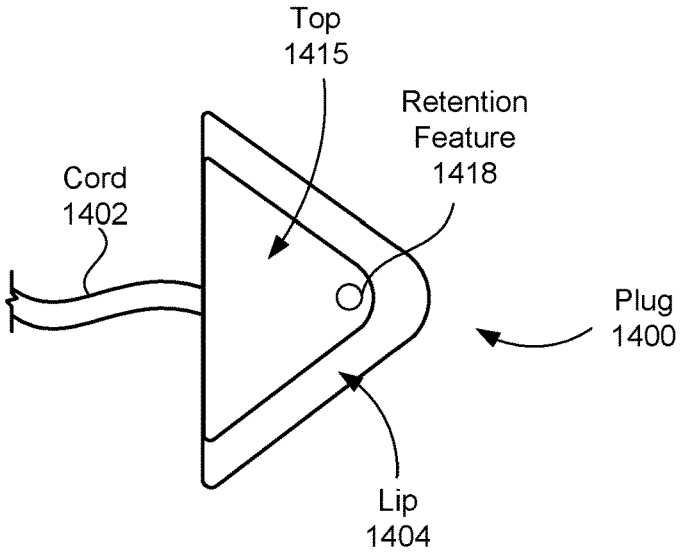
FIG. 14C is a top view of the plug shown in FIGS. 14A, 14B according to an example embodiment.

FIG. 14C is a top view of the plug 1400 shown in FIGS. 14A and 14B according to an example embodiment. As shown in FIG. 14C, the lip 1404 extends beyond a top of the plug 1400, around the front and sides of the plug 1400. The plug 1400 may also include a retention feature 1418. The retention feature 1418 may include a recessed area configured to receive a retention feature of the socket. The retention feature 1418 may be on the top 1415 of the plug 1400, or on the bottom 1417 of the plug 1400.

Figure 15A:
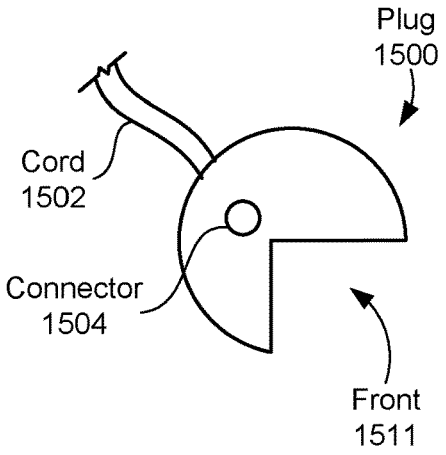
FIG. 15A is a diagram of a plug according to an example embodiment.

FIG. 15A is a diagram of a plug 1500 according to an example embodiment. In this example, the plug 1500 is coupled to a cord 1502 which includes electrical wires. The plug 1500 may be circular shaped with a square, triangular, or wedge-shaped portion removed. The plug 1500 may also include a connector 1504. The connector 1504 may be a conductive material, such as metal, which couples to the wires within the cord 1502 and transmits electrical power and/or signals to the computing device via the socket. In this example, the plug 1500 is rounded or circular, with a square, triangular, or wedge-shaped portion missing from a front 1511 portion of the plug 1500. The front 1511 portion may be considered a portion of the plug 1500 on an opposite end from the cord 1502.

Figure 15B:
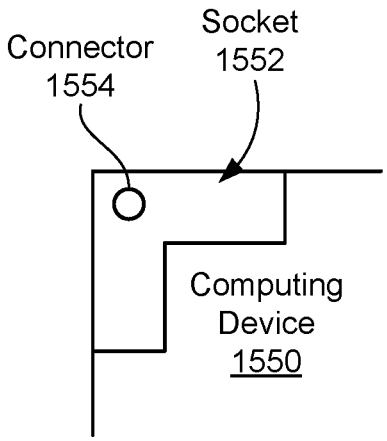
FIG. 15B is a diagram showing a top cut-away view of a computing device including a socket configured to receive the plug shown in FIG. 15A according to an example embodiment.

FIG. 15B is a diagram of a cutout view of a computing device 1550 including a socket 1552 configured to receive the plug 1500 shown in FIG. 15A according to an example embodiment. The socket 1552 may be located on a corner of the computing device 1552. In this example, the socket 1552 is L-shaped and configured to receive the plug 1500 shown in FIG. 15A. The socket 1552 may include a connector 1554 configured to couple with the connector 1504 of the plug 1500.

Figure 16A:
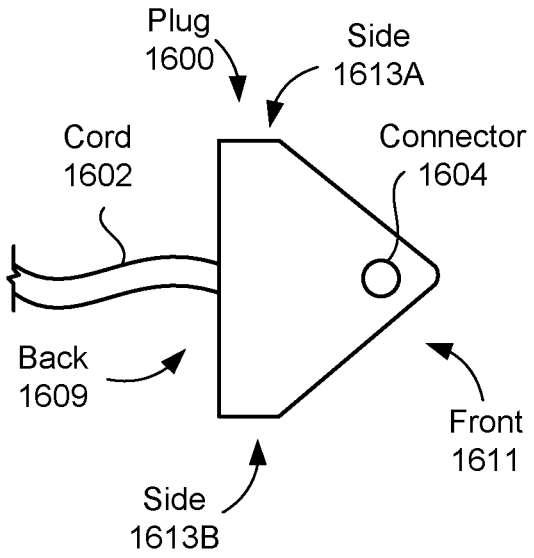
FIG. 16A is a diagram showing a plug with a triangular front portion according to an example embodiment.

FIG. 16A is a diagram showing a plug 1600 with a triangular front portion 1611 according to an example embodiment. The plug 1600 may be connected to a cord 1602. The cord 1602 may include one or more electrical wires configured to carry electrical power and/or signals.

In this example, the plug 1600 has a triangular front portion 1611 and may have a flattened back portion 1609. Side portions 1613A, 1613B may be perpendicular to the back portion 1609. The sides 1613A, 1613B and back portion 1609 may form a rectangle, with the triangular front portion 1611 extending from the rectangle. The plug 1600 may also include a connector 1604. The connector 1604 may electrically couple to a connector of a socket.

Figure 16B:
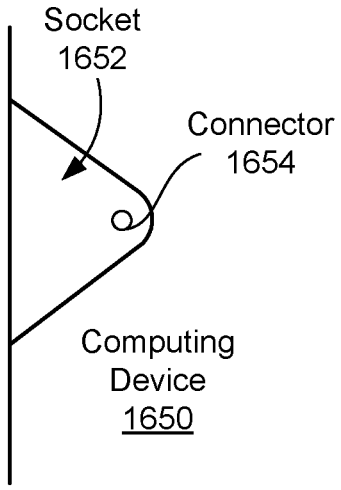
FIG. 16B is a diagram showing a top cut-away view of a computing device with a socket configured to receive the plug shown in FIG. 16A according to an example embodiment.

FIG. 16B is a diagram showing a cutout view of a computing device 1650 with a socket 1652 configured to receive the plug 1600 shown in FIG. 16A according to an example embodiment. In this example, the socket 1652 is triangular and configured to receive the triangular front portion 1611 of the plug 1600. The sides 1613A, 1613B may extend out of the socket 1652. The socket 1652 includes a connector 1654 configured to receive the connector 1604 of the plug 1600. The connector 1654 is configured to couple with the connector 1604 of the plug 1600 and transmit electrical power and/or signals between the computing device 1650 and plug 1600.

Figure 16C:
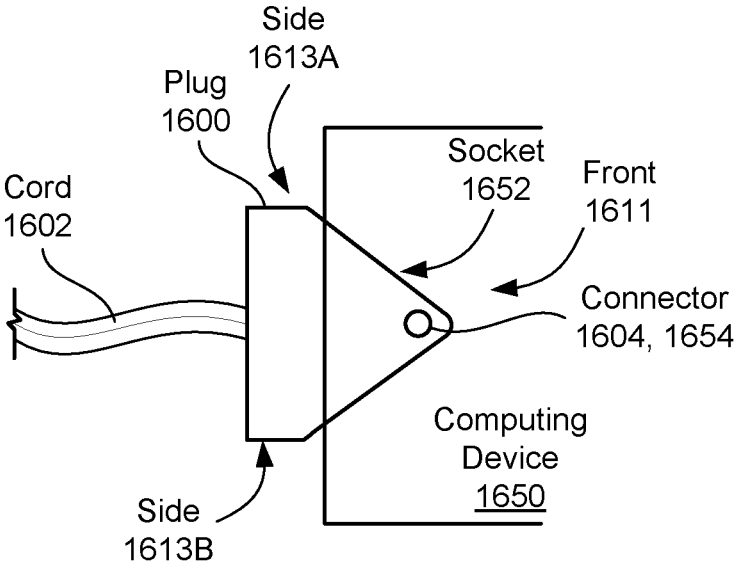
FIG. 16C is a diagram showing a top cut-away view of the plug inserted into the socket of the computing device according to an example embodiment.

FIG. 16C is a diagram showing a cutout view of the plug 1600 inserted into the socket 1652 of the computing device 1650 according to an example embodiment. In this example, the connectors 1604, 1654 are engaged with each other. The front 1611 of the plug 1600 is flush with the socket 1652, and the connector 1604 of the plug 1600 engages the connector 1654 of the socket 1652. The sides 1613A, 1613B of the plug 1600 are outside the socket 1652.

Figure 16D:
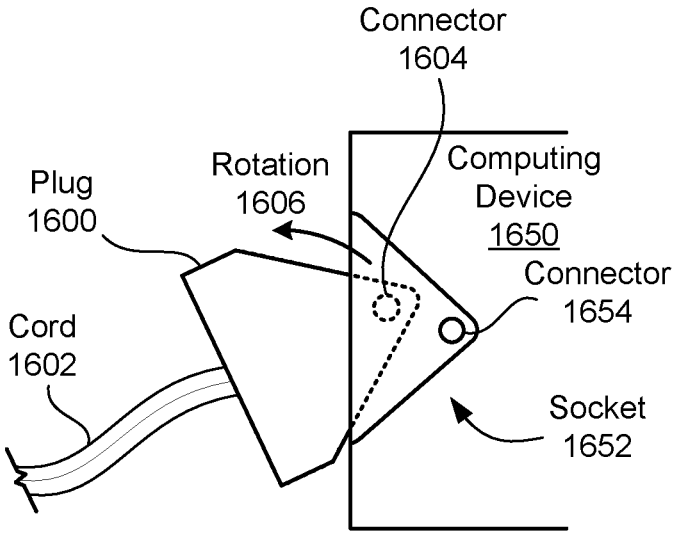
FIG. 16D is a diagram showing the plug being pulled out of the socket of the computing device according to an example embodiment.

FIG. 16D is a diagram showing the plug 1600 being pulled out of the socket 1652 of the computing device 1650 according to an example embodiment. In this example, the cord 1602 has been pulled sideways in a direction of rotation 1606, pulling the plug 1600 sideways out of the socket 1652. Because of the relatively wide width of the socket 1652 compared to the depth of the socket 1652, and because of the triangular shape of the plug 1600 and socket 1652, the plug 1600 falls out of the socket 1652 without causing damage to either the plug 1600 or the socket 1652.

Figure 16E:
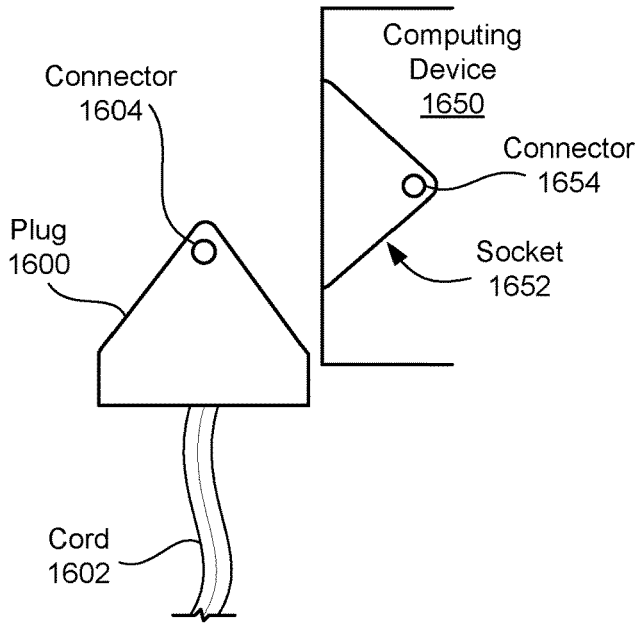
FIG. 16E shows the plug fully removed from the socket according to an example embodiment.

FIG. 16E shows the plug 1600 fully removed from the socket 1652 according to an example embodiment. In this example, the plug 1600 has been pulled away from the socket 1652 without causing damage to either the plug 1600 or the socket 1652.

Figure 17A:
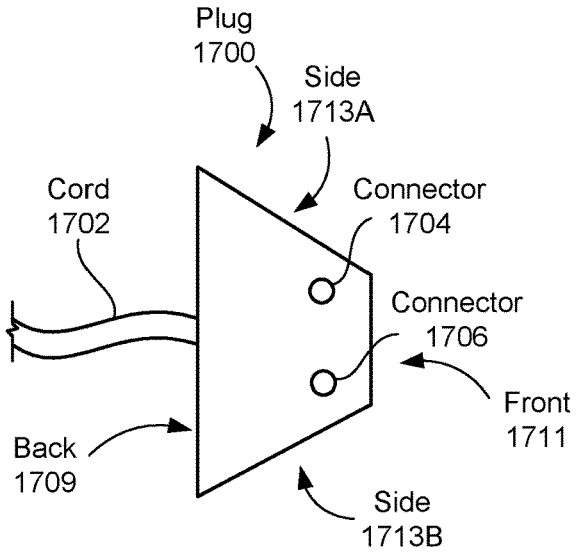
FIG. 17A is a diagram showing a quadrilateral plug according to an example embodiment.

FIG. 17A is a diagram showing a isosceles trapezoidal plug 1700 according to an example embodiment. The plug 1700 is connected to a cord 1702 which includes one or more electrical wires which may carry electrical power and/or data. The cord 1702 enters into a back 1709 of the plug 1700.

In this example, the plug 1700 is isosceles trapezoidal with a front 1711 and back 1709 parallel to each other, and the front 1711 being shorter than the back 1709. The sides 1713A, 11713B form acute angles with the back 1709, and form obtuse angles with the front 1711. In this example, the plug 1700 includes two connectors 1704, 1706 which may connect to connectors of the socket to transmit electrical power and/or signals. The sides 1713A, 1713B and/or front 1711 may also include connectors, either on outside surfaces or recessed channels. of the sides 1713A, 1713B and/or front 1711.

Figure 17B:
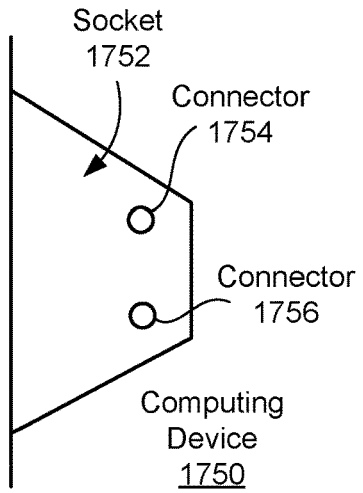
FIG. 17B is a diagram showing a cut-away view of a computing device including a socket configured to receive the plug according to an example embodiment.

FIG. 17B is a diagram showing a cutout view of a computing device 1750 including a socket 1752 configured to receive the plug 1700 according to an example embodiment. In this example, the socket 1752 is a isosceles trapezoidal with a shape corresponding to the plug 1700. The socket 1752 may include connectors 1754, 1756 configured to electrically couple to the connectors 1704, 1706 of the plug 1700, thereby transmitting electrical power and/or signals between the plug 1700 and socket 1752 of the computing device 1750.

Figure 18A:
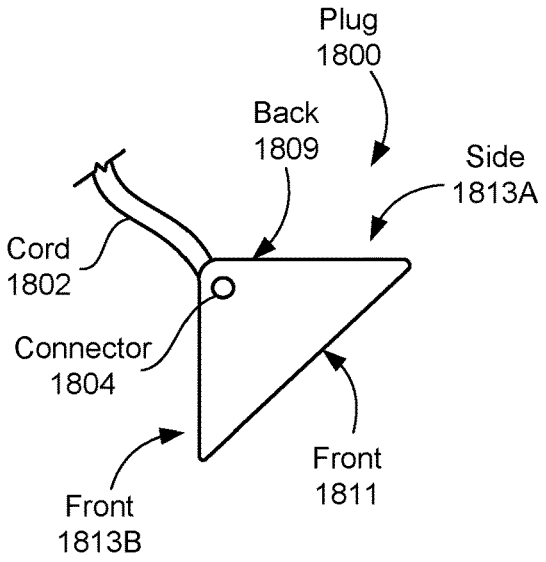
FIG. 18A is a diagram showing a plug in the shape of an inverted triangle according to an example embodiment.

FIG. 18A is a diagram showing a plug 1800 in the shape of an inverted triangle according to an example embodiment. The plug 1800 may be connected to a cord 1802. The cord 1802 may include at least one electrical wire for transmitting electrical power and/or signals. The cord 1802 may enter a back 1809 of the plug 1800.

In this example, the front 1806 of the plug 1800 is wide and flat, and a back 1809 is formed at the intersection of two sides 1813A, 1813B. The sides 1813A, 1813B may have approximately equal length, causing the plug 1800 to form an isosceles triangle.

The plug 1800 may also include a connector 1804 at or near the back 1809 of the plug 1800. The connector 1804 may transmit and/or receive electrical power and/or signals to a connector of the socket of a computing device.

Figure 18B:
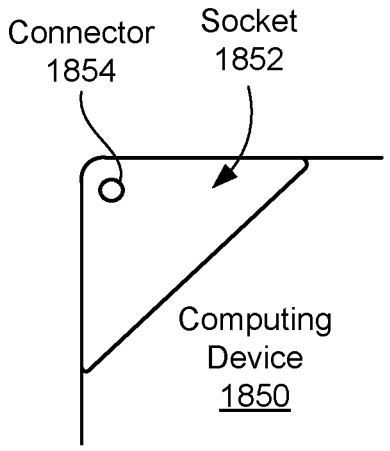
FIG. 18B is a diagram showing a top cut-away view of a computing device with a socket on a corner of the computing device according to an example embodiment.

FIG. 18B is a diagram showing a cutout view of a computing device 1800 with a socket 1852 on a corner of the computing device 1850 according to an example embodiment. In this example, the socket 1852 is triangular with a flatter wide portion on the interior of the socket 1852. The socket 1852 is shaped to receive the plug 1800 shown in FIG. 18A. The socket 1852 may include a connector 1854. The connector 1854 may electrically couple the connector 1804 of the plug 1800 to the computing device 1850.

Figure 18C:
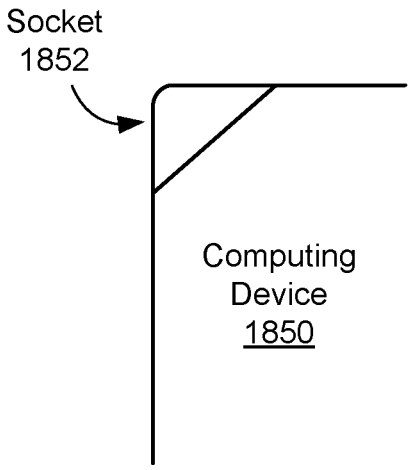
FIG. 18C is another diagram showing a top cut-away view of the computing device with the socket on a corner of the computing device according to an example embodiment.

FIG. 18C is another diagram showing a cutout view of the computing device 1850 with the socket 1852 on a corner of the computing device 1850 according to an example embodiment.

Figure 18D:
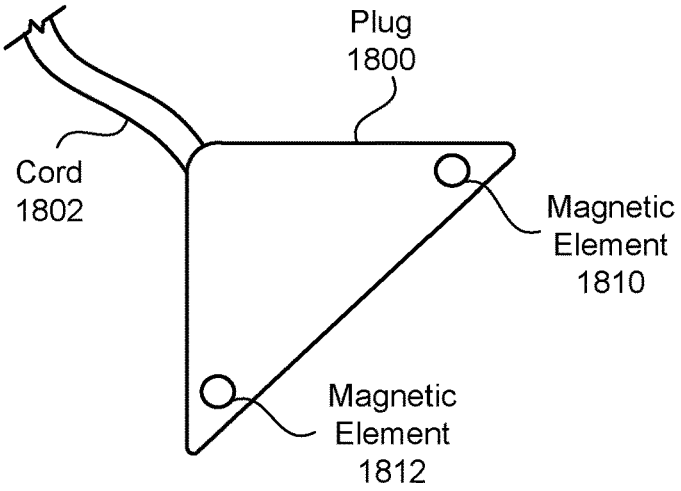
FIG. 18D is a diagram of the triangular shaped plug in an example in which the plug includes magnetic elements according to an example embodiment.

FIG. 18D is a diagram of the triangular-shaped plug 1800 in an example in which the plug 1800 includes magnetic elements 1810, 1812 according to an example embodiment. The magnetic elements 1810, 1812 may couple to magnetic elements of the socket 1852 to secure the plug 1800 within the socket 1852.

Figure 18E:
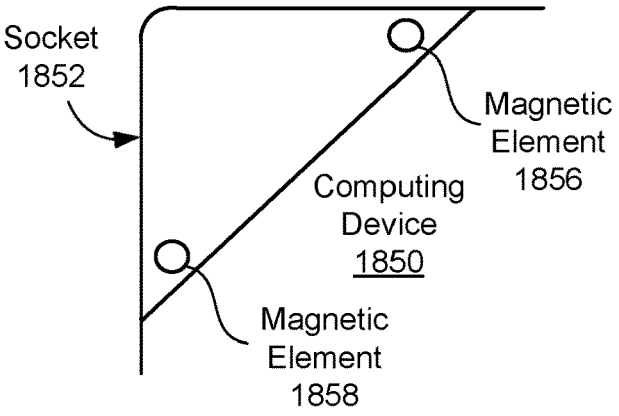
FIG. 18E is a diagram showing a top cut-away view of the computing device with the socket configured to secure the plug shown in FIG. 18D according to an example embodiment.

FIG. 18E is a diagram showing a cutout view of the computing device 1850 with the socket 1852 configured to secure the plug 1800 shown in FIG. 18D according to an example embodiment. In this example, the socket 1852 includes magnetic elements 1856, 1858 which may couple with the magnetic elements 1810, 1812, thereby securing the plug 1800 within the socket 1852. The magnetic elements 1856, 1858 may be in locations within the socket 1852 corresponding to the locations of the magnetic elements 1810, 1812 on the plug 1800.

Figure 18F:
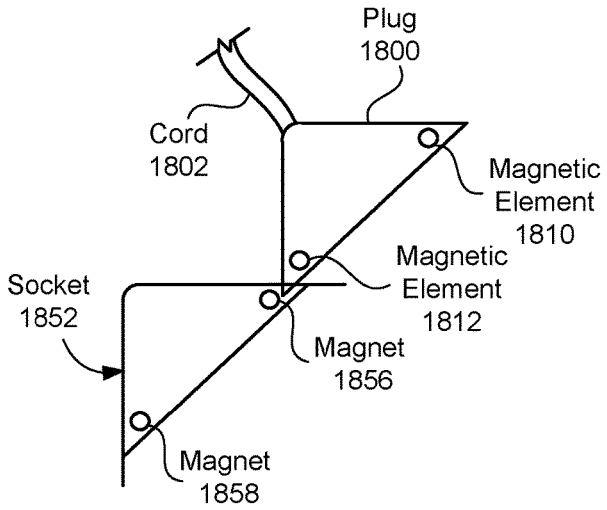
FIG. 18F is a diagram showing the plug being inserted into the socket according to an example embodiment.

FIG. 18F is a diagram showing the plug 1800 being inserted into the socket 1852 according to an example embodiment. The plug 1800 may slide into the socket 1852 until the magnetic elements 1810, 1812 align with and couple to the magnets 1856, 1858 of the socket 1852. Sliding the plug 1800 into the socket 1852 may clean ferromagnetic debris, such as small bits of metal, from the socket 1852, which may have attached to the socket magnets 1856, 1858.

Figure 18G:
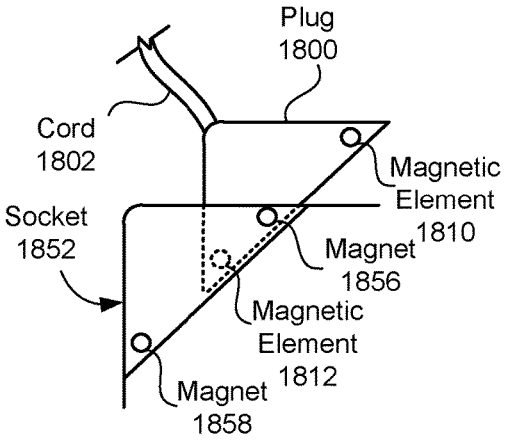
FIG. 18G shows the plug being slid into the socket according to an example embodiment.
Figure 18H:
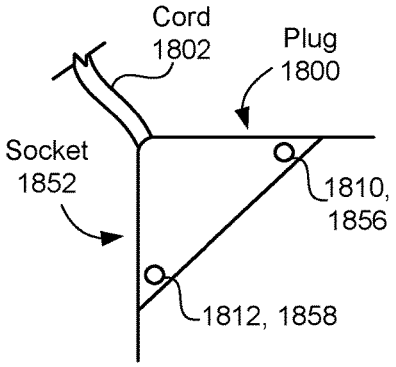
FIG. 18H shows the plug fully inserted into the socket according to an example embodiment.

FIG. 18G shows the plug 1800 being inserted into the socket 1852 according to an example embodiment. In FIG. 18H, the plug 1800 has been fully inserted into the socket 1852 so that the magnetic element 1810 couples with the magnetic element 1856, and the magnetic element 1812 couples with the magnetic element 1858, securing the plug 1800 within the socket 1852.

Figure 19A:
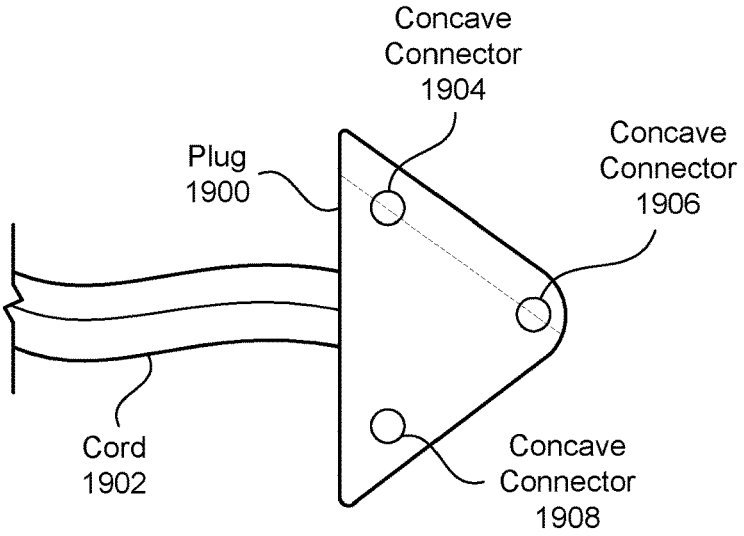
FIG. 19A shows a plug in an example in which the plug is triangular shaped and includes concave connectors according to an example embodiment.

FIG. 19A shows a plug 1900 in an example in which the plug 1900 is triangular shaped, similar in shape to the plug 1300 shown and described with respect to FIG. 13A, and includes concave connectors 1904, 1906, 1906 according to an example embodiment. In this example, the plug 1900 is triangular with the narrow portion of the triangle at a front. In this example, the connectors 1904, 1906, 1908 are also retaining devices and/or retention members. The plug 1900 may include concave connectors 1904, 1906, 1908 at each corner of the plug. The concave connectors may receive securing elements from the socket. The plug 1900 may connected to a cord 1902. The cord 1902 may include an electrical wire which transmits electrical power and/or signals.

Figure 19B:
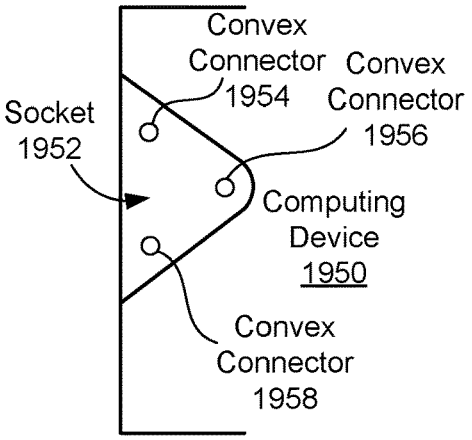
FIG. 19B is a diagram showing a top cut-away view of a socket configured to receive the plug shown in FIG. 19A according to an example embodiment.

FIG. 19B is a diagram showing a top cut-away view of a socket 1952 configured to receive the plug 1900 shown in FIG. 19A according to an example embodiment. In this example, the socket 1952 may include convex connectors 1954, 1956, 1958, which may also function as retaining devices and/or retention members. The convex connectors 1954, 1956, 1958 may be made of an electrically conductive material, such as metal, to transmit electrical power and/or signals between the computing device 1950 and the plug 1900. The convex connectors 1954, 1956, 1958 may insert into and engage concave connectors 1904, 1906, 1908, thereby electrically coupling the convex connectors 1954, 1956, 1958 to the concave connectors 1904, 1906, 1908 and securing the plug 1900 within the socket 1952.

Figure 19C:
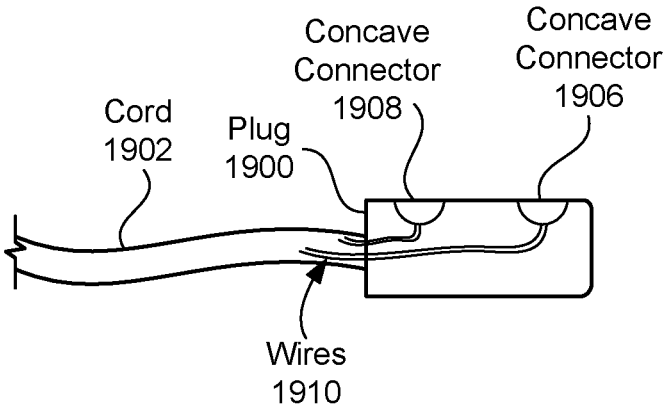
FIG. 19C is a diagram showing a side cut-away view of the plug of FIG. 19A according to an example embodiment.

FIG. 19C is a diagram showing a side cut-away view of the plug 1900 according to an example embodiment. The cut-away may be along the dashed line shown in FIG. 19A. In this example, the concave connectors 1906, 1908 (as well as concave connector 1904 not shown in FIG. 19C) may include recessed regions on a top of the plug 1900. Wires 1910 may extend through the plug 1900 into the concave connectors 1906, 1908 to transmit power and/or signals to the concave connectors 1906, 1908 via the cord 1902.

Figure 19D:
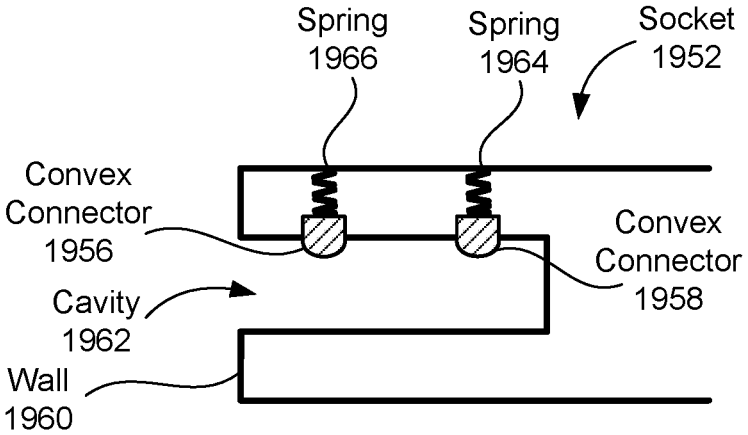
FIG. 19D is a diagram showing a side cut-away view of the socket of FIG. 19B according to an example embodiment.

FIG. 19D is a diagram showing a side cut-away view of the socket 1952 according to an example embodiment. In this example, a wall 1960 may define a cavity 1962 in which the plug 1900 is inserted. The convex connectors 1956, 1958 may extend into the cavity 1962. The socket 1952 may include springs 1964, 1966 which bias or press the convex connectors 1956, 1958 into the cavity 1906. The biasing or pressing of the convex connectors 1956, 1958 into the cavity 1962 by the springs 1964, 1968 allows the convex connectors 1956, 1958 to engage with the concave connectors 1906, 1908 of the plug 1900 and secure the plug 1900 within the socket 1952. While two concave connectors 1906, 1908 and two convex connectors 1956, 1958 are shown in FIGS. 19C and 19D, this is for illustrative purposes; the plug 1900 may include three concave connectors 1904, 1906, 1908 as shown in FIG. 19A, and the socket 1952 may include three convex connectors 1954, 1956, 1958 as shown in FIG. 19B, according to an example embodiment.

Figure 20A:
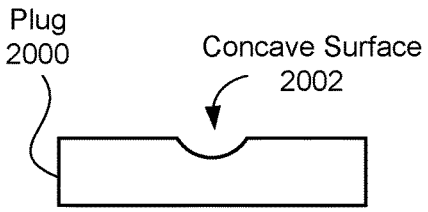
FIG. 20A is a diagram of a plug which includes a concave surface according to an example embodiment.

FIG. 20A is a diagram of a plug 2000 which includes a concave surface 2002 according to an example embodiment. In this example, the concave surface 2002 is a rounded recessed portion.

Figure 20B:
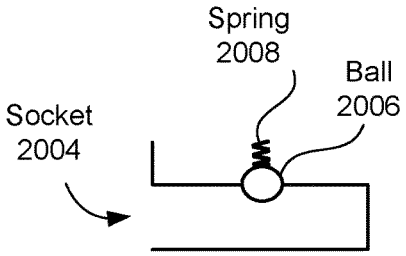
FIG. 20B is a diagram showing a cut-away view of a socket configured to receive the plug of FIG. 20A according to an example embodiment.

FIG. 20B is a diagram showing a cutout view of a socket 2004 configured to receive the plug 2000 of FIG. 20A according to an example embodiment. In this example, a spring 2008 presses a ball 2006 into the socket 2004. The pressing of the ball 2006 by the spring 2008 into the socket 2004 allows the ball 2006 to rest within the concave surface 2002 of the plug 2000, securing the plug 2000 within the socket 2004. The location of the ball 2006 and the concave surface 2002 in the center of the socket 2004 and plug 2000, respectively, may allow the plug 2000 to rotate within the socket 2004.

Figure 20C:
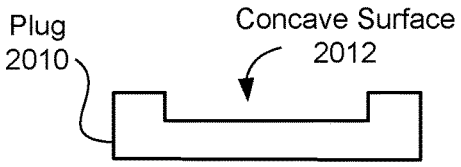
FIG. 20C is a diagram of a plug with a concave surface according to an example embodiment.

FIG. 20C is a diagram of a plug 2010 with a concave surface 2012 according to an example embodiment. In this example, the concave surface 2012 may be a wide rectangular recessed portion of the plug 2010. The wide rectangular concave surface 2012 may allow the plug 2010 to rotate and/or slide within the socket.

Figure 20D:
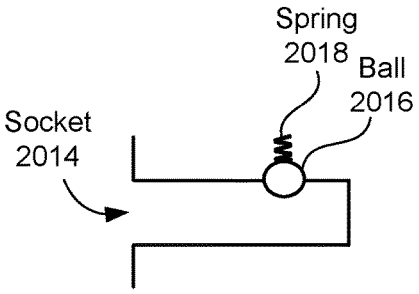
FIG. 20D is a diagram showing a cut-away view of a socket configured to receive the plug of FIG. 20C according to an example embodiment.

FIG. 20D is a diagram showing a cutout view of a socket 2014 configured to receive the plug 2000 of FIG. 20C according to an example embodiment. In this example, the socket 2014 may include a ball 2016 which extends into the socket 2014 to engage the plug 2010. A spring 2018 may bias or press the ball 2016 into the socket 2014 in a similar manner to the ball 2006 and spring 2008, described above with respect to FIG. 20B.

Figure 20E:
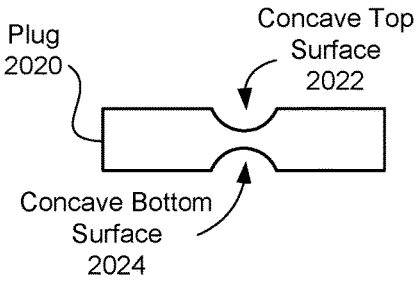
FIG. 20E is a diagram showing a plug with both a concave top surface and a concave bottom surface according to an example embodiment.
Figure 20F:
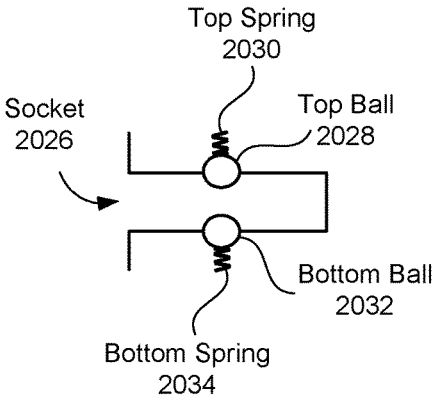
FIG. 20F shows a cut-away view of a socket configured to receive the plug shown in FIG. 20E according to an example embodiment.

FIG. 20E is a diagram showing a plug 2020 with both a concave top surface 2022 and a concave bottom surface 2024 according to an example embodiment. In this example, both the top and bottom surfaces 2022, 2024 are concave, allowing the socket to engage retention features on both sides. While FIG. 20E shows the concave surfaces 2022, 2024 as being rounded, they may also be rectangular.

FIG. 20F shows a cutout view of a socket 2026 configured to receive the plug 2020 shown in FIG. 20E according to an example embodiment. In this example, the socket 2026 includes retention features on both the top and bottom to engage both the concave top surface 2022 and the concave bottom surface 2024 of the plug 2020. In this example, a top retention mechanism may include a top ball 2028 which extends into the socket 2026, and a top spring 2030 which presses the top ball 2028 into the socket 2026. The bottom retention mechanism may include a bottom ball 2032 which extends into the socket 2036, and a bottom spring 2034 which presses the bottom ball 2032 into the socket 2026. The location of the balls 2028, 2032 and the concave surfaces 2022, 2024 in the center of the socket 2026 and plug 2020, respectively, may allow the plug 2002 to rotate within the socket 2026.

Figure 20G:
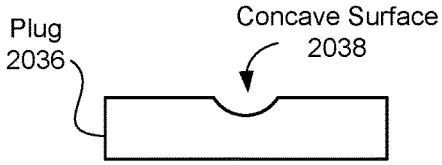
FIG. 20G shows a plug in an example in which the plug includes a concave surface according to an example embodiment.

FIG. 20G shows a plug 2036 in an example in which the plug 2036 includes a single concave surface 2038 according to an example embodiment. The concave surface 2038 may be rounded and configured to receive a retention mechanism of a socket.

Figure 20H:
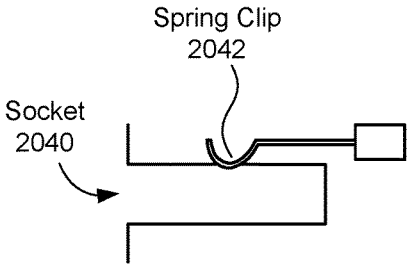
FIG. 20H shows a cut-away view of a socket which is configured to receive the plug shown in FIG. 20G according to an example embodiment.

FIG. 20H shows a cutout view of a socket 2040 which is configured to receive the plug 2036, shown in FIG. 20G according to an example embodiment. In this example, the retention mechanism includes a spring clip 2042. The spring clip 2042 may include a wire or sheet of metal with a rounded portion that extends into the socket 2042. The spring clip 2042 may be biased to extend into the socket 2040. The rounded portion of the spring clip 2042 may enter into and engage the concave surface 2038 of the plug 2036, securing the plug 2036 within the top socket 2040. The location of the spring clip 2042 and the concave surface 2038 in the center of the socket 2040 and plug 2036, respectively, may allow the plug 2036 to rotate within the socket 2040.

Figure 20I:
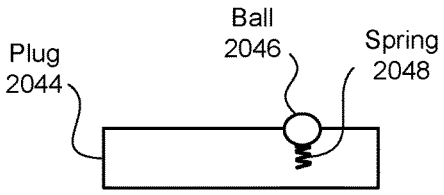
FIG. 20I shows a plug with a retention mechanism in which the retention mechanism extends out of the plug according to an example embodiment.

FIG. 20I shows a plug 2044 with a retention mechanism in which the retention mechanism extends out of the plug 2044 according to an example embodiment. In this example, the retention mechanism of the plug 2044 includes a ball 2046 and a spring 2048. The spring 2048 may press the ball 2046 out and away from the plug 2044.

Figure 20J:
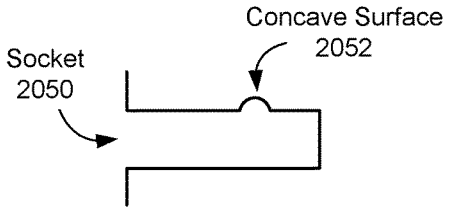
FIG. 20J shows a cut-away view of a socket configured to receive the plug shown in FIG. 20I according to an example embodiment.

FIG. 20J shows a cutout view of a socket 2050 configured to receive the plug 2044 shown in FIG. 20I according to an example embodiment. In this example, the socket 2050 includes a concave surface 2052 configured to receive the ball 2046 of the plug 2044. The ball 2046 may enter into the concave surface 2052 of the socket 2050, securing the plug 2044 within the socket 2050.

Figure 20K:
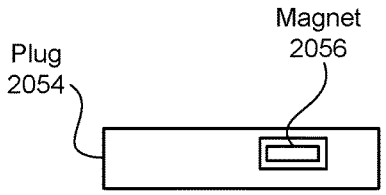
FIG. 20K is a diagram showing a plug in an example in which the retention mechanism includes a magnet.

FIG. 20K is a diagram showing a plug 2054 in an example in which the retention mechanism includes a magnet 2056. In this example, the magnet 2056 may engage a magnet of the socket.

Figure 20L:
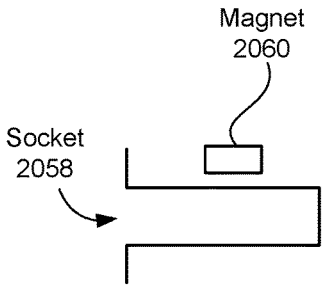
FIG. 20L is a diagram showing a cut-away view of a socket configured to receive the plug shown in FIG. 20K according to an example embodiment.

FIG. 20L is a diagram showing a cutout view of a socket 1258 configured to receive the plug 2054 shown in FIG. 20K according to an example embodiment. In this example, the socket 2058 may include a magnet 2060. The magnet 2060 of the socket 2058 may couple to the magnet 2056 of the plug 2054, securing the plug 2054 within the socket 2058. Either the plug 2054 or the socket 2058 may include a ferromagnetic element such as a piece of steel, instead of the magnets 2056, 2060 shown in FIGS. 20K and 20L. A ferromagnetic element may not accumulate ferromagnetic debris.

Any of the plugs 2000, 2010, 2020, 2036, 2044, 2054 shown in FIGS. 20A, 20C, 20E, 20G 201, 20K may include plugs and/or connectors as described above with respect to any of the other plugs described herein. Any of the sockets 2004, 2014, 2026, 2040, 2050, 2058 may be included in a computing device or electrical device, and may include connectors as described above with respect to any of the above sockets described herein.

While certain features of the described implementations have been illustrated as described herein, many modifications, substitutions, changes and equivalents will now occur to those skilled in the art. For example, while a computing device has been described as including the sockets described herein, and into which the plugs described herein are inserted, a device including any of these sockets may include any electrical device which receives electrical power and/or signals. It is, therefore, to be understood that the appended claims are intended to cover all such modifications and changes as fall within the true spirit of the embodiments of the invention.

What is claimed is:

1. An electrical connector comprising:

a plug comprising:

a top;

a curved recessed channel extending around sides and a front of the plug;

a bottom on an opposite side of the plug from the top, the bottom including a lip extending beyond the recessed channel a greater distance than the top extends beyond the recessed channel; and electrical connectors extending through the recessed channel; and a cord extending from a back of the plug, the back of the plug being opposite from the front of the plug, the cord including one or more electrical wires, wherein the top of the plug has a triangular shape when viewed from a direction perpendicular to a direction in which the cord extends from the back of the plug.

2. The electrical connector of claim 1, wherein the bottom has a greater surface area than the top.

3. The electrical connector of claim 1, wherein a bottom depth of the plug, measured from a back of the bottom to a front of the lip included in the bottom, is greater than a top depth of the plug, the top depth of the plug being measured from a back of the top to a front of the top.

4. The electrical connector of claim 3, wherein both the top depth and the bottom depth are greater than a height of the plug, the height of the plug being measured from the top to the bottom.

5. The electrical connector of claim 1, wherein the top and the bottom have triangular shapes.

6. An electrical connector comprising: a plug including: a flat front portion comprising at least one power connector; a flat top portion adjacent to the flat front portion, the flat top portion having a triangular shape; a flat bottom portion adjacent to the flat front portion; a back portion adjacent to the flat top portion and the flat bottom portion; and at least one magnetic element positioned on the flat top portion; and a cord connected to the back portion of the plug, the cord including at least one electrical wire.

7. The electrical connector of claim 6, wherein the flat top portion is perpendicular to the flat front portion and parallel to the flat bottom portion.

8. The electrical connector of claim 6, wherein the back portion is opposite from the flat front portion.

9. The electrical connector of claim 6, wherein:

the plug further comprises:

a first flat side portion adjacent to the flat front portion, the flat top portion, and the flat bottom portion; and a second flat side portion adjacent to the flat front portion, the flat top portion, and the flat bottom portion; and the back portion is formed at an intersection of the first flat side portion and the second flat side portion.

10. The electrical connector of claim 6, wherein:

the plug forms an isosceles triangle; and the back of the plug is formed at an intersection of two equal length sides of the plug, the two equal length sides each being adjacent to the flat front portion, the flat top portion, and the flat bottom portion.

11. The electrical connector of claim 6, wherein the at least one magnetic element is configured to couple to a magnetic element of a socket to secure the plug within the socket.

12. The electrical connector of claim 6, wherein the at least one magnetic element comprises two magnetic elements in corner portions of the flat top portion opposite from the back of the plug, the magnetic elements being configured to couple to a magnetic element of a socket of a computing device to secure the plug within the socket.

13. The electrical connector of claim 12, further comprising a connector near the back of the plug, the connector being configured to transmit and receive signals to and from the socket.

14. The electrical connector of claim 6, further comprising a connector near the back of the plug, the connector being configured to transmit and receive signals to and from a socket of a computing device.

15. A computing device comprising: a plurality of walls defining a triangular socket in a corner portion of the computing device, the plurality of walls defining the triangular socket comprising opposing top and bottom socket walls and a back socket wall adjacent to both the top and bottom socket walls, the top and bottom socket walls each having a triangular shape and the back socket wall having a rectangular shape; and an electrical connector extending into the triangular socket, the electrical connector being configured to electrically couple the computing device to a plug inserted into the socket, wherein the triangular socket extends from a first sidewall of the computing device to a second sidewall of the computing device.

16. The computing device of claim 15, further comprising magnetic elements configured to couple with magnetic elements of the plug to secure the plug within the socket.

17. The computing device of claim 15, wherein the computing device comprises: the first sidewall; a third sidewall adjacent to and perpendicular to the first sidewall; a fourth sidewall adjacent to the third sidewall, the fourth sidewall being perpendicular to the third sidewall and parallel to the first sidewall; the second sidewall adjacent to the fourth sidewall, the second sidewall being perpendicular to the fourth sidewall and parallel to the third sidewall; the back socket wall adjacent to the first sidewall and the second sidewall; a top portion adjacent to the first sidewall, the second sidewall, the third sidewall, and the fourth sidewall, the top portion extending beyond the back socket wall, a portion of the top portion which extends beyond the back socket wall comprising the top socket wall; and a bottom portion adjacent to the first sidewall, the second sidewall, the third sidewall, and the fourth sidewall, the bottom portion extending beyond the back socket wall, a portion of the bottom portion which extends beyond the back socket wall comprising the bottom socket wall.

18. The computing device of claim 17, wherein the top socket wall further comprises magnetic elements extending into the triangular socket, the magnetic elements being configured to couple with magnetic elements of the plug to secure the plug within the socket.

* * * * *